US005225320A

United States Patent [19]

Kuse et al.

[11] Patent Number: 5,225,320

[45] Date of Patent: Jul. 6, 1993

[54] METHOD OF PROCESSING A SILVER HALIDE COLOR PHOTOSENSITIVE MATERIAL SUBSTANTIALLY FREE OF RINSING AND A STABILIZING SOLUTION USED THEREFOR

[75] Inventors: Satoru Kuse, Hino; Shigeharu Koboshi, Sagamihara, both of Japan

[73] Assignee: Konishiroku Photo Industry Co., Ltd., Tokyo, Japan

[21] Appl. No.: 873,608

[22] Filed: Apr. 22, 1992

Related U.S. Application Data

[63] Continuation of Ser. No. 643,096, Jan. 22, 1991, abandoned, which is a continuation of Ser. No. 393,847, Aug. 14, 1989, abandoned, which is a continuation of Ser. No. 233,901, Aug. 17, 1988, abandoned, which is a continuation of Ser. No. 913,371, Sep. 30, 1986, abandoned.

[30] Foreign Application Priority Data

Oct. 1, 1985 [JP] Japan ..... 60-218919

[51] Int. Cl.[5] ..... G03C 7/30; G03C 7/42; G03C 7/40

[52] U.S. Cl. ..... 430/372; 430/384; 430/385; 430/393; 430/428; 430/429; 430/463; 430/493; 430/546; 430/553; 430/963

[58] Field of Search ..... 430/372, 384, 385, 428, 430/429, 463, 493, 546, 553, 963, 393

[56] References Cited

U.S. PATENT DOCUMENTS

| | | | |
|---|---|---|---|
| 2,213,477 | 9/1940 | Steindorff et al. | 568/606 |
| 2,913,338 | 11/1959 | Bates et al. | 430/372 |
| 3,369,896 | 2/1968 | Seemann et al. | 430/372 |
| 3,404,004 | 10/1968 | Ake | 430/963 |
| 4,385,110 | 5/1983 | Yoneyama et al. | 430/372 |
| 4,451,558 | 5/1984 | Sugita et al. | 430/553 |
| 4,537,856 | 8/1985 | Kurematsu et al. | 430/372 |
| 4,540,653 | 9/1985 | Nishijima et al. | 430/372 |
| 4,562,144 | 12/1985 | Kurematsu et al. | 430/429 |
| 4,567,134 | 1/1986 | Koboshi et al. | 430/372 |
| 4,590,150 | 5/1986 | Fujita | 430/428 |
| 4,687,731 | 8/1987 | Ishikawa et al. | 430/372 |
| 4,731,320 | 3/1988 | Sasakie et al. | 430/546 |
| 4,752,556 | 6/1988 | Kishimoto | 430/398 |
| 4,778,748 | 10/1988 | Kuse et al. | 430/428 |
| 4,849,333 | 7/1989 | Fujita . | |

*Primary Examiner*—Richard L. Schilling
*Attorney, Agent, or Firm*—Finnegan, Henderson, Farabow, Garrett & Dunner

[57] ABSTRACT

Method of processing a silver halide color photosensitive material which comprises the steps of a developing process, a bleach-fixing solution or a fixing solution, and then, without washing with water, treated with a stabilizing solution. The method is characterized in that the silver halide color photo sensitive material comprises a high boiling point organic solvent having a dielectric constant of 3.5 or more and the stabilizing solution comprises silicone having the surface tension 20 to 60.

9 Claims, No Drawings

METHOD OF PROCESSING A SILVER HALIDE COLOR PHOTOSENSITIVE MATERIAL SUBSTANTIALLY FREE OF RINSING AND A STABILIZING SOLUTION USED THEREFOR

This application is a continuation of application Ser. No. 07/643,096, filed Jan. 22, 1991, now abandoned, which was a continuation of application Ser. No. 07/393,847 filed Aug. 14, 1989, abandoned, which was a continuation of application Ser. No. 07/233,901 filed Aug. 17, 1988, abandoned, which was a continuation of application Ser. No. 06/913,371 filed Sep. 30, 1986, abandoned.

FIELD OF THE INVENTION

This invention relates to a method of processing a silver halide color photosensitive material without using any substantial rinsing step and also to a non-rinsing stabilizing solution suitably used therefor, and more particularly, to a method of processing a novel silver halide color photosensitive material which is excellent in storage stability against light in a high temperature and high humidity atmosphere and whose unexposed surface is free of stains, and a stabilizing solution used therefor.

BACKGROUND OF THE INVENTION

Generally, a silver halide color photosensitive material which has been exposed to light is processed by developing, bleach-fixing and rinsing steps or developing, bleaching, rinsing, fixing, rinsing and stabilizing steps but such method of processing has encountered the problem involved in the preservation of environments or water resources which has recently been deemed important. Therefore, there have been proposed various methods for reducing the amount of rinsing water which is used in large quantities. For example, the specification of German Patent No. 2,920,222 and a technical literature entitled "Water Flow Rate in Immersion-Washing of Motion Picture Film" (Journal, SMPTE. 64, pages 248–253, May (1955) by S. R. Goldwasser) are known as showing techniques for reducing the amount of rinsing water by reverse-flowing the water through a plurality of tanks. Further, there are described in the Japanese Laid-open Patent Publications Nos. 57-8543, 58-14834 and 58-134636 methods for processing a photosensitive material in a stabilized condition without substantially performing a rinsing step.

However, although all of the above prior art techniques have been proposed to control the environmental pollution by reducing the amount of supply of rinsing water, they are quite insufficient with respect to the time-lasting preservation of a photographic image and especially, they have the disadvantage of presenting a high degree of color fading due to light in a high-temperature and high-humidity atmosphere. Further, it has been found that the above problem is liable to take place depending on the variation of processing conditions (mixing conditions or temperature of the processing bath) due to the use of a stabilizing agent free of rinsing.

Further, the number of mini-labs has been increasing and those which have already been installed throughout the country count about 3,000 in number as of May, 1985. It is said that about one-third of them was installed in the past one year period. Certainly, an unprecedented mini-lab boom! Most of those mini-labs use a non-rinsing stabilizing solution because of the requirements of compactness, pipelessness and simplicity. However, it has been found that many of the mini-labs have disadvantages in that when a photosensitive material is processed by such mini-labs, the stabilizing solution is enriched to increase the salt density resulting in an increase in the accumulation of an irradiation-proof pigment or a sensitizing dye dissolving and flowing from the photosensitive material with stains generating on the material.

At the same time, with the recent mini-lab boom, each company in this field of industry has come to develop and sell a variety of kinds of automatic developing machines but the mixing systems for stabilizing solutions and capacities of such developing machines are versatile tending to produce too large differences in mixing capacity among them and it is the actual circumstances that there are some mini-labs which are extremely undesirable with respect to the prevention of stains generating on the photosensitive material. Above all, such stains are remarkable on the unexposed section of the photosensitive material and in the case of color paper, since the unexposed section is white, even a light stain makes itself a serious defect while in the case of a negative color film, the exposure-time of the printer is affected thereby so much as to produce a color unbalance.

Further, it has been found that in case a color image is stored, the generation of such stain deteriorates the durability of the color image especially in a high-temperature and high-humidity atmosphere.

SUMMARY OF THE INVENTION

Accordingly, and object of this invention is to provide a method of processing a photosensitive material which method requires substantially no rinsing, is energy saving and has a small pollution load, and also to provide a stabilizing solution used therefor.

Another object of this invention is to provide a method of processing a photosensitive "material which method is adopted to prevent the lowering of preservation stability of a colored image at the time of continuous processing, especially due to light in a high-temperature and high-humidity atmosphere by using a stabilizing solution requiring substantially no rinsing, and also to provide such stabilizing solution.

Still another object of this invention is to provide a method of processing a photosensitive material adopted to prevent the generation of stains on the unexposed section of the material taking place when the material is discontinuously processed for a prolonged period of time and by a small amount of non-rinsing stabilizing solution, and also to provide such stabilizing solution.

A further object of this invention is to provide a method of processing a photosensitive material which method controls the generation of bubbles of the stabilizing solution when the material is conveyed at a high-speed (e.g., higher than 3 m/min.) during processing, prevents the bubbles from mixing into other processing solutions thereby preventing the stabilizing solution from being wasted to no purpose, and also to provide a non-rinsing stabilizing solution used for the method.

A still further object of this invention is to provide a method of processing a photosensitive material which is capable of obtaining a highly-stabilized colored image even during a high-speed process (e.g., more than 3 m/min.) in a lab and in any other conditions, and also to provide a stabilizing solution free of rinsing.

An additional object of this invention is to provide a non-rinsing stabilizing solution which is added with a chemical compound capable of preventing the generation of bubbles of the stabilizing solution without reducing the efficiency of the solution.

DETAILED DESCRIPTION OF THE INVENTION

The method of processing a silver halide color photosensitive material according to this invention features that in case the material is processed with a solution having a fixing capacity and subsequently processed with a non-rinsing stabilizing solution, substantially without rinsing process therebetween, the photosensitive material contains a high-boiling point organic solvent having a dielectric constant of 3.5 and higher and that the surface tension of the non-rinsing stabilizing solution is in the order of 20–60 dyne/cm..

It has been found that according to a preferred embodiment of this invention, the above-mentioned stabilizing solution contains a compound or emulsion type silicone so that the object of the invention can be effectively achieved.

Further, it has been found that according to a still more favorable embodiment of this invention, the effect of the invention can be better displayed especially when the silver halide color photosensitive material contains a high boiling-point organic solvent having a dielectric constant of 3.5 and higher as shown by the following general formula [I] or [II].

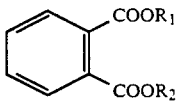

General formula [I]

wherein Rand $R_2$ designate an alkyl group and alkenyl or aryl group, respectively.

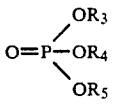

General formula [II]

wherein $R_3$, $R_4$ and $R_5$ designate an alkyl group and an alkenyl or aryl group, respectively.

The non-rinsing stabilizing solution in accordance with one of the most preferable embodiments of the invention contains a silicone.

This invention will now be described in further detail.

It has hitherto been known that as described in the Japanese Patent Examined Publication No. 49-26262, the Research Disclosure No. 17431 and the Japanese Laid-open Patent Publication No. 59-17551, a specific silicone compound is added to a final processing solution, which is not a non-rinsing stabilizing solution and follows after fixing and rinsing steps, for the purpose of preventing the uneven distribution of waterdrops on the film. However, this invention features that a photosensitive material containing a high boiling-point organic solvent having a specific dielectric constant is processed with a non-rinsing stabilizing solution having a specific surface tension. Particularly, the effect of this invention can be more favorably displayed by adding a siliconic to the non-rinsing stabilizing solution following the use of a processing solution having a fixing capacity such as fixation or bleach-fixation, and in this respect, this invention differs from the conventional technique according to which a silicon compound is added to the final processing solution which is used as a mere stabilizing bath after rinsing, for the purpose of preventing the uneven distribution of waterdrops on the film.

The silicone used for this invention belong to organopolysiloxanes which are described, for example, in "Chemical Encyclopedia," 14th abridged-edition Volume IV, page 872, Kyoritsu Publishing Co., Ltd., Sep. 15, 1972. Further, a preferred silicone compound is one that is generally known as an anti-bubbling agent together with solvents such as specific surface active agents and alcoholic solvents.

Further, the silicones used in this invention are of oil type, solution type, compound type and emulsion type and the following compounds may be given as belonging to the above types of silicone.

(i) Oil type
- FS anti-foam 200 (manufactured by Dow Corning Corp.)
- L-45 (manufactured by Nihon Unicar Co., Ltd.)

(ii) Solution type
- FS XD-2889 (manufactured by Dow Corning Corp.)
- FS XD-2898 (")

(iii) Compound type
- FS anti-foam DB-100 (manufactured by Dow Corning Corp.)
- FS anti-foam 544 (")
- FS anti-foam 001 (")
- FS anti-foam 026A (")
- SAG-47 (manufactured by Nihon Unicar Co., Ltd.)
- SAG-100 (")
- SAG-471 (")
- SAG-3300 (")
- FZ-328 (")
- FZ-334 (")
- FZ-5604 (")
- FZ-5603 (")

(iv) Emulsion type
- FS anti-foam 545 (manufactured by Dow Corning Corp.)
- FS-anti-foam 013B (")
- FS anti-foam AFE (")
- FS anti-foam DB-31 (")
- FS anti-foam DB-110N (")
- FS anti-foam 025 (")
- FS anti-foam 009 (")
- FS anti-foam CE (")
- FS anti-foam BE (")
- FZ-336 (Nihon Unicar Co., Ltd.)
- FZ-5205 (")
- SAG-30 (")
- SAG-10 (")
- SAG-3310 (")
- SAG-3390 (")
- SAG-3393 (")
- SAG-3395 (")
- UNISAT (")
- FZ-340 (")
- Anti-foam E-20 (manufactured by Kao Corp.)
- Anti-foam 90 (manufactured by Dow Corning Corp.)

Of the above types of silicones, the compound and emulsion type silicones can be favorably used for producing the effect of this invention. Further, in the case of this invention, the emulsion time silicones are especially favorable in view of stability.

It is preferable that each type of silicones of this invention be used in the range of 1 mg to 1 g of pure silicone per 1 l of the non-rinsing stabilizing solution and more preferably in the range of 3 mg to 200 mg. When exceeding 1 g, a stain tends to generate on the surface of the photosensitive material and, when lower than 1 mg, the effect of the invention tends to reduce.

As means for adding the silicone of this invention to the stabilizing solution, there are a method of dropping an undiluted silicone solution continuously or according to necessity; a method of spraying the silicone solution; a method of adding the silicone solution to the replenishing solution or applying it to the photosensitive material; a method of attaching the silicon solution to the photosensitive material by adding the solution to a bath (prebath) having a fixing capacity; and a method of adding the silicone solution by coating the solution to the wall surface of a non-rinsing stabilization tank and liquating it bit by bit into the tank.

The surface tension of the non-rinsing stabilizing solution used for the processing according to this invention is in the order of 20–60 dyne/cm when measured at a temperature of 20° C. by the general measuring method described in the literature entitled "Analysis of surface active agents and testing method" (written by Fumio Kitahara, Shigeo Hayano and Ichiro Hara and issued by Kodansha Book Co., Ltd. on May 1, 1982).

To determine the surface tension of the non-rinsing stabilizing solution to be in the order of 20–60 dyne/cm (at 20° C.), various kinds of agents may be used but the use of a surface active agent is preferable. Such surface active agent may be added to the solution in a tank together with a replenishing solution or may be attached to the photosensitive material through a prebath. Further, it is also possible to add the agent to the non-rinsing stabilizing solution by liquating it from the photosensitive material.

Of the surface active agents available for this invention, compounds expressed by the following general formulae [III] to [VI] may preferably be used.

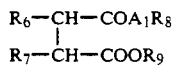

General formula [III]

wherein either $R_6$ or $R_7$ designates a hydrogen atom and the other designates a group expressed by the formula $SO_3M$ (wherein M designates a hydrogen atom or monovalent cation, $A_1$ designates an oxygen atom or a group expressed by the formula—$NR_{10}$—(wherein $R_{10}$ designates a hydrogen atom or an alkyl group having 1–8 carbon atoms and $R_8$ and $R_9$ designate an alkyl group having 4–16 carbon atoms, provided that the alkyl groups expressed by $R_8$ and $R_9$ or $R_{10}$ may be substituted by fluorine atoms. General formula [IV]

$$A_2—0—(B)m—X_1$$

wherein $A_2$ designates a monovalent organic group such as an alkyl group having 6–20 carbon atoms, preferably 6–12 (for example, hexyl, heptyl, octyl, nonyl, decyl, undecyl or dodecyl group) or an aryl group substituted by an alkyl group having 3–20 carbon atoms and as aryl group, there are given such groups as phenyl, tolyl, xynyl, biphenyl and naphthyl of which the phenyl or toryl group is preferable. As to the position at which the aryl group is bonded to the alkyl, any of the o-position, m-position and p-position will do. Further, B designates ethylene oxide or propylene oxide, m designates an integer in the order of 4–50 and $X_1$ designates a hydrogen atom, $SO_3Y$ or $PO_3Y_2$ (wherein Y designates a hydrogen atom, alkali metal atom (e.g., Na, K or Li, etc.) or ammonium ion.

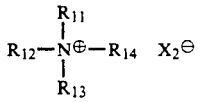

General formula [V]

wherein $R_{11}$, $R_{12}$, $R_{13}$ and $R_{14}$ designate a hydrogen atom, an alkyl group and a phenyl group, respectively, with the total number of carbon atoms in the order of 3–50. $X_2\ominus$ designates an anion of a halogen atom, hydroxyl group, sulfonic acid group, carbonic acid group, nitric acid group, acetic acid group, p-toluensulfonic acid group, etc.

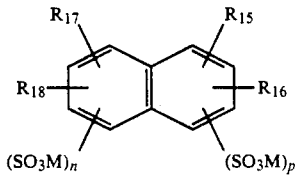

General formula [VI]

wherein $R_{15}$, $R_{16}$, $R_{17}$ and $R_{18}$ independently represents a hydrogen atom and an alkyl group, and M is equivalent to the general formula [III]. n and p designate 0 or integers of 1–4 which are values satisfying the formula of $1 \leqq n+p \leqq 8$.

The following are typical examples of the chemical compounds expressed by the general formulae of [III] to [VI].

(Chemical compounds expressed by the general formula [III])

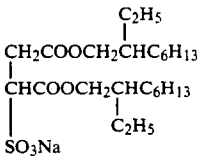

(i)

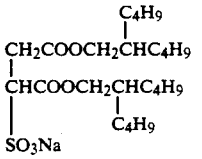

(ii)

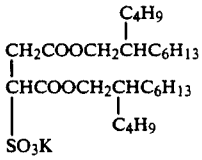

(iii)

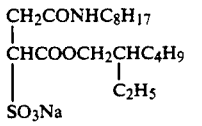

(iv)

-continued
(v)
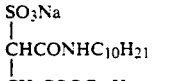
(vi)
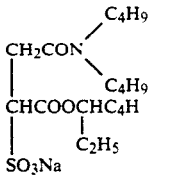
(vii)
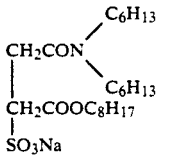
(viii)
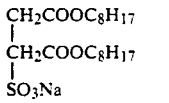
(ix)
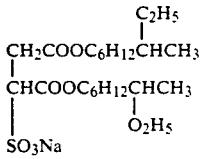
(x)
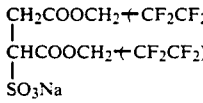
(xi)
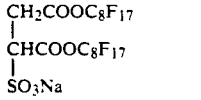
(xii)
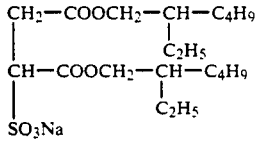
(Chemical compounds expressed by the general formula [IV])
$C_{12}H_{25}O(C_2H_4O)_{10}H$ (i)
$C_8H_{17}O(C_3H_6O)_{15}H$ (ii)
$C_9H_{19}O(C_2H_4O)_4SO_3Na$ (iii)
$C_{10}H_{21}O(C_2H_4O)_{15}PO_3Na_2$ (iv)
(v)
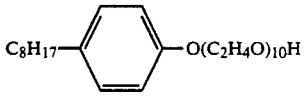
(vi)
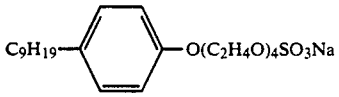
-continued
(vii)
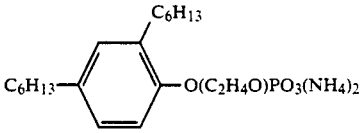
(viii)
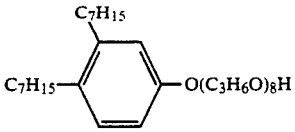
(ix)
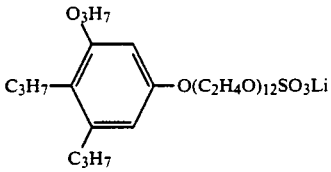
(x)
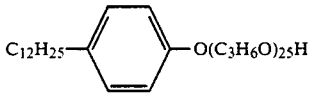
(xi)
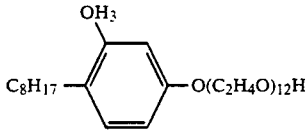
(xii)
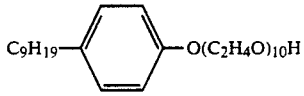
(xiii)
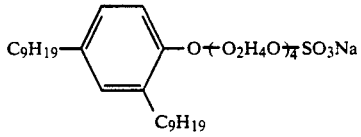
$C_{12}H_{25}O(O_2H_4O)_4SO_3Na$ (xiv)
(Chemical compounds expressed by the general formula [V])
(i)
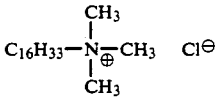
(ii)
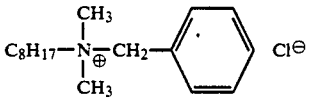
(iii)
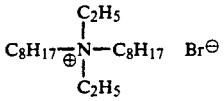
(iv)
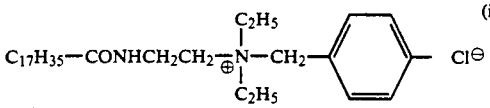

-continued (v) $C_{17}H_{35}-CONHCH_2CH_2-\overset{\oplus}{N}(CH_3)_2-CH_2CH_2OH \quad NO_3^{\ominus}$ (vi) $C_{17}H_{35}-\overset{\oplus}{N}(CH_3)_3 \quad Br^{\ominus}$ (vii) $C_{12}H_{25}-S-CH_2-\overset{\oplus}{N}(CH_3)_2-CH_2CH_2OH \quad Cl^{\ominus}$ (viii) $C_{11}H_{23}-COOCH_2CH_2NHCOCH_2-\overset{\oplus}{N}(CH_3)_3 \quad Cl^{\ominus}$ (ix) $C_{12}H_{25}-\overset{\oplus}{N}(CH_3)_2-CH_2-C_6H_5 \quad Cl^{\ominus}$ (x) $C_{12}H_{25}-\overset{\oplus}{N}(CH_3)(CH_2CH_2O)_{\frac{1}{2}}H\,(CH_2CH_2O)_{\frac{1}{2}}H \quad Cl^{\ominus}$ (Chemical compounds expressed by the general formula [VI])

(i) 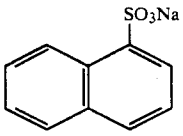

(ii) 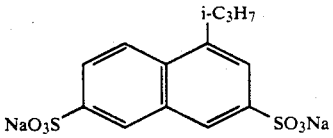

(iii) 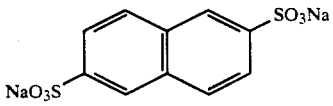

(iv) 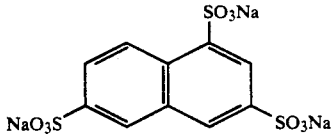

(v) 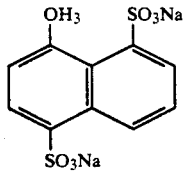

(vi) 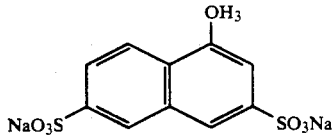

-continued (vii) 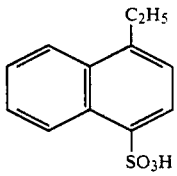

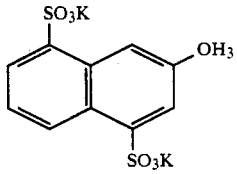

(ix) 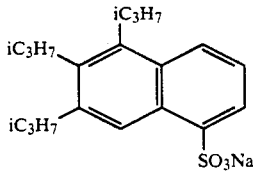

(x) 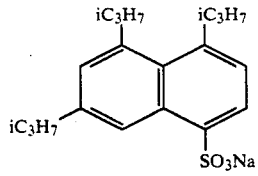

The effect aimed at by this invention can be achieved by controlling the surface tension of the stabilizing agent added with the above-mentioned surface active agent to fall within the range of 20–60 dyne/cm and especially, a favorable result can be obtained when the surface tension is in the range of 25–50 dyne/cm.

Further, in the case of this invention, the photosensitive material is usually processed by the non-rinsing stabilizing solution and then dried but it is optional to further rinse the material or processed with a cleaning solution containing formalin, a surface active agent, etc.

Next, examples of processing steps to which the processing method of this invention applies will be shown. Note that in the examples, the letter S designates a stabilizing solution and the letter F designates a solution having a fixing capacity.

(a) Color development→bleach→fixation (F)→S→drying (b) Color development bleach rinse→fixation (F)→S→cleaning→drying (c) Color development→bleach→fixation (F)→S→cleaning→drying (d) Color development→blix (F)→S→drying (e) Color development→blix (F)→S→drying (f) MonoBath color development-blix (F)→S→drying Development→rinse→reversal→color development→color correction bleach→fixation (F)→S→cleaning →drying Of course, the processing method according to this invention is not limited to the above examples but the examples (b), (c), (e) and (g) are particularly preferable for the method according to this invention.

The method according to this invention produces a great effect when it is applied to a continuous processing (for continuously processing a photosensitive material while keeping the processing capacity of the processing solution constant by replenishing the solution so as to remove fatigue due to processing). Usually, automatic processors of various types including hanger-, roll-, sheet- and cine-types are used for continuous processing and this invention can be preferably used for continuous processing using such processors. Further, it is desirable that the automatic processor be provided with a squeege or a blade for preventing the solution from being brought out from a bath containing a solution having fixing capacity by the photo-sensitive material and brought into the stabilizing bath.

The non-rinsing stabilizing solution according to this invention has a pH in the order of 3–9.5 and is gifted with an anti-molding property so that it produces another effect of removing dirt from the surface of the photosensitive material after drying, in addition to the afore-mentioned effects of the invention.

The term, "photographic processing solutions (each having a fixing capacity)" given herein means solutions which are intended for desilvering in the course of processing a photosensitive material and which include, for example, a fixing solution, bleaching-fixing solution, monobath developing-fixing solution, hardening-fixing solution, monobath developing-bleaching-fixing solution, etc.

The expression, "to process a photosensitive material with a processing solution having a fixing capacity and to process the material with a non-rinsing stabilizing solution without taking any substantial rinsing step" means a process in which the photosensitive material is subjected to a stabilizing process immediately after it has been processed with a processing solution having a fixing capacity instead of being rinsed. In this case, the processing solution used for stabilization is called a non-rinsing stabilizing solution as above-mentioned and a tank for storing such solution is called a non-rinsing stabilizing bath (or tank) or merely a stabilizing bath or tank.

However, in case the concentration of a fixing solution or bleaching-fixing solution in the non-rinsing stabilizing bath or tank (the foremost stabilizing tank when the bath comprises two and more sub-baths or tanks) does not exceed 1/2000, the photosensitive material may be subjected to rinsing, auxiliary rinsing and rinsing promotion processings for an extremely short time according to a single or multiple tank counter-current flow system.

As the described above, the processing of a photosensitive material by the non-rinsing stabilizing solution is performed after the material is fixed.

As chemical compounds preferably used with the non-rinsing stabilizing solution according to this invention are chelating agents whose chelating stability constant is 6 and more to iron ions and these agents can be preferably used for achieving the objects of this invention.

The term, "a chelating stability constant" herein means a constant generally known from such literatures as L. G. Sillen. A. E. Martell, "Stability Constants of Metal-ion Complexes," and "Organic Sequestering Agents," Wiley (1959).

As the chelating agents of the above type, there are organic carboxylic acid chelating agents, organic phosphoric acid chelating agents, inorganic phosphoric acid chelating agents, polyhydroxy compounds, etc. Note that the above-mentioned iron ions are ferric ions ($Fe^{3+}$).

As the concrete examples of chelating agents having a chelating stability constant of 6 and more to iron ions, there are given the following compounds though not limited thereto. That is, ethylenediaminediorthohydroxyphenyl acetic acid, diaminopropanetetraacetic acid, nitrilotriacetic acid, hydroxyethylenediaminetriacetic acid, dihydroxyethylglisine, ethylenedia mineoiacetic acid, iminodiacetic acid, diethylenetriaminepentaacetic acid, hydroxyethyliminodi- acetic acid, diaminopropanoltetraacetic acid, trans-cyclohexanediaminetetraacetic acid, grycoletherdiaminetetraacetic acid, ethylenediaminetetrakismethylenephosphoric acid, nitrotrimethylenephosphoric acid, 1-hydroxyethylidene-1, 1-diphosphonic acid, 1, 1-diphosphonoethane-2-carboric acid, 2-phosphonobutane-1, 2, 4-tricarboxylic acid, 1-hydroxy-1-phosfonopropane-1, 2, 3-tricarbonic acid, catechol-3, 5 -diphosphonic acid, sodium pyrrolinate, sodium tetrapolyphosphate and sodium hexamethaphosphate, and among them, 1-hydroxyethylidene-1,1-diphosphoric acid is most favorably used.

It is preferable that the amount of each of the above chelating agents be in the order of 0.01–50 g per 1 l of the non-rinsing stabilizing solution and more preferably be in the order of 0.05–20 g.

When replenishing amount of the non-rinsing stabilizing solution is less than 0.5 times that of the solution carried from the prebath per unit area, the amount of prebath component stored in the non-rinsing stabilizing solution increases to lower the preservation stability of the photographic color image while, when it is more than 50 times the latter, the effect of this invention reduces. Therefore, it is desirable in the invention to use the solution in the order of 0.5–50 times the latter. Especially, when the amount of supply of the solution is in the order of 2–30 times that of the prebath solution, a particularly favorable effect will be produced and it is most desirable that the solution is applied to the photosensitive material by 2000 ml per 1 $m^2$ of the material.

The tank for storing the non-rinsing stabilizing solution according to this invention may be only one in number but it is possible to have some two to ten tanks to produce a more favorable effect. Further, a supply of fresh non-rinsing stabilizing solution to the existing one may be made at several portions but it is preferable to supply the fresh solution into the tank located rearward when viewed from the direction of the processing line of the photosensitive material so that the solution overflows into the tank just ahead of the first-mentioned tank (including a case in which the solution flows through a pipe lying below the liquid level so as to establish communication between the tanks). More preferably, the non-rinsing stabilizing solution in more than two tanks is replenished into the last tank so that the solution overflowing that tank transfers to the tank there behind. In this case, a part or the whole of the overflow of the stabilizing solution next to the solution having a fixing capacity may be discarded or the latter solution may be allowed to flow into the former solution.

As means for imparting an anti-molding property to the non-rinsing stabilizing solution according to this invention, there are both mechanical and physical means.

As a concrete example of the mechanical means, there is a method of adding an anti-molding agent to the non-rinsing stabilizing solution. Favorable anti-molding agents are sorbic acid, benzoic acid compounds, phenol compounds, thiazole compounds, pyridine compounds, guanidine compounds, carbonate compounds, morpholine compounds, quantenary phosphonic compounds, urea compounds, isoaxazole compounds, propanolamino compounds, sulfanide compounds, pyrronone compounds and amino-acid compounds.

The above-mentioned benzoic acid compounds include salicylic acid, hydroxybenzoic acid, and methylester, ethylester, propylester and decylester as ester compounds of hydroxybenzoic acid but n-butylester of hydroxybenzoic acid, isobutylester, propylester and salicylic acid are preferable and a mixture of the three esters of the above-mentioned hydroxybenzoic acid is the most favorable.

The phonol compounds may have a halogen atom, nitro group, hydroxyl group, carbonic acid group, amino group, alkyl group (especially of C 1–6) or phenyl group as substituents, and orthophenylphenol, orthoocyclohexaphenol, nitrophenol, chlorophenol, cresol, glycol, aminophenol and phenol are preferable.

Thiazol compounds are those having nitrogen and sulfur atoms in their penta cycle and favorable of them are 1, 2-benzisothiazoline 3-on, 2-methyl-4-isothiazoline 3-on, 2-octyl-4-isothiazoline 3-on, 5-chloro-2-methyl-4-isothiazoline 3-on and 2-chloro-thiazolyl-benzimidazol.

Pyridine compounds include cyclohexydine, polyhexamethylenebiguanidine hydrochloride, dodecylguanidine hydrochloride, etc. of which dodecylguanidine and its salts are preferable.

Carbamate compounds include methyl-1-(butylcarbamoyl)-2-benzimidazol carbamate, etc.

Morpholine compounds include 4-(3-nitrobutyl) morpholine, 4-(3-nitrobutyl) morpholine, 4-(3-nitrobutyl) morpholine, etc.

Tetraphosphonium compounds include tetraalkylphosphonium salt, tetraalcoxyphosphonium salt, etc. and preferable of them is tetraalkylphosphonium salt and more preferable are tri-phenylnitrophenylphosphonium chloride and triphenyl nitrophenylphosphonium chloride.

Tetraammonium compounds include benzalconium salt, benztnium salt, tetraalkylammonium salt, alkylpyridium salt, etc. and to be more concrete, they include dodecyldimethylbenzylammonium chloride, dodecyldimethylammonium chloride, laurelpyridium chloride, etc.

Urea compounds include N-(3, 4-dichlorophenyl) -n-(4-chlorophenol) urea, N-(3-trifluoromethyl) -N'-(4-chlorophenyl) urea, etc.

Isoxazole compounds include 3-hydroxy-5-methylisoxazole, etc.

Propanolamine compounds include n-propanols and isopropanols and to be more concrete, they are DL-2-benzilamino-1-propanol, 3-diethylamino-1-propanol, 2-dimethylamino-2-methyl-1-propanol, 3-amino-1-propanol, isopropanolamine, diisopropanolamine, N,N-dimethylisopropanolamine, etc.

Sulfamide compounds include o-nitrobenzene sulfamide, p-aminobenzene-sulfamide, fluorosulfamide, 4-chloro-3, 5-dinitrobenzenesulfamide, α-amino-p-truenesulfamide, sulfanylamide, acetosulfaguanidine, sulfamethyzol, sulfathiazol, sulfadiazine, sulfameradine, sulfamethadine sulfaisooxazol, homosulfamine, sulfamidine, sulfaguanidine, sulfamethysol, sulfapyradine, phtalisosulfathiasol, succinisulfathiasol, etc.

Amino acid compounds include n-laurel-β-alanine.

Further, of the above-mentioned anti-molding agents, those compounds which are preferably used in this invention are thiazole compounds, sulfamide compounds, pyronone compounds, etc.

It is preferable that the amount of addition of the anti-molding agent to the non-rinsing stabilizing solution be used in the range of 0.001–30 g per 1 l of the solution and it is more preferably used in the range of 0.003 g–5 g.

As the physical means to give an anti-molding property to the solution, ultraviolet rays may be applied to the non-rinsing stabilizing solution or a magnetic field may be caused to pass through the solution.

To subject the non-rinsing stabilizing solution to a magnetic field in this invention is to cause the solution to pass through a magnetic field generating between a positive pole and a negative pole. In this case, the photosensitive material may or may not be passed through the magnetic field.

The magnetic field used in this invention may be obtained by using a permanent magnet consisting of ferromagnetic iron, cobalt and nickel or a coil through which a DC current flows or any other suitable means for producing a magnetic field. The magnetic line of force of the magnetic field may be generated by using a single magnet or by arranging two magnets of positive and negative polarities in opposite relationship with each other.

There are various methods for subjecting the non-rinsing stabilizing solution of this invention to a magnetic field. For example, a permanent magnet may be moved through the stabilizing solution or an externally arranged permanent magnet is moved (or rotated) or the non-rinsing stabilizing solution is transferred by agitation or circulation. As a particularly desirable method, a permanent magnet may be fixed to a part or the whole of the outside or inside of a circulation pipe and the stabilizing solution is circulated through the pipe. In this case, the permanent magnet may be formed by the pipe itself or it may be attached to the entire length of the pipe.

In the case of an automatic developer, the above purpose can be achieved by providing a permanent magnet in the non-rinsing stabilizing bath but as described hereinbefore, it is preferable to arrange the magnet in the circulation system of the stabilizing bath (including intermediate tanks or other members). Further, in case the non-rinsing stabilizing process comprises a multistage stabilizing bath, it is most preferable to subject to a magnetic field the stabilizing solution in the non-rinsing stabilizing bath but it is also preferable to subject the stabilizing solution other than that in the non-rinsing stabilizing bath nearest the processing solution having a fixing capacity, to a magnetic field. Alternatively, a resin lining containing a material capable of generating a magnetic line of force may be applied to the non-rinsing stabilizing bath itself, preferably to the internal surface of the bath, or such lining may be applied to the circulation system, thereby subjecting the stabilizing solution to the magnetic field.

Further, the method of applying ultraviolet rays on the non-rinsing stabilizing solution according to this invention can be performed by using a commercially available ultraviolet ray lamp or an ultraviolet ray irradiation device and in this case, it is preferable for the lamp to have an output of 5–800 W (the tube output) though not always limited thereto.

According to a preferred embodiment of this invention, the wavelength of ultrasonic rays of light is in the order of 220 nm–350 nm. Further, as an ultraviolet ray irradiating method, there is a method in which ultraviolet rays are irradiated directly from the above-mentioned lamp or device provided in or outside the non-rinsing stabilizing bath.

The organic solvents used for the photosensitive material to be processed according to this invention are chemical compounds each having a dielectric constant of 3.5 and over. They are, for example, esters such as phthalic acid ester and phosphoric acid ester, organic acid amides, ketone, hydrocarbon compounds, etc. Preferable high-boiling point solvents are those having a dielectric constant in the order of 4.0–8.5 of which those belonging to phthalic acid esters or phosphoric acid esters are more preferable. Further, they may be mixtures of more than two kinds of compounds provided that they have a dielectric constant of 3.5 and higher. By the way, the dielectric constant mentioned herein is that measured at 30° C.

As phthalic acid esters advantageously used in this invention include those given hereunder which are expressed by the following general formula [I].

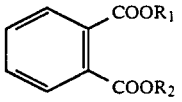

General formula [I]

wherein $R_1$ and $R_2$ designate an alkyl group and an alkenyl or aryl group, respectively. However, it is preferable that the total carbon atom number of the groups expressed by $R_1$ and $R_2$ be in the range of 2–36 and the range of 6–24 is more preferable.

In this invention, the alkyl groups expressed by $R_1$ and $R_2$ of the above-mentioned general formula [I] are those of straight chain or branching, such as butyl groups, pentyl groups, hexyl groups, heptyl groups, octyl group, nonyl group, decyl group, undecyl group, dodecyl group, tridecyl, pentadecyl, hexadecyl, heptadecyl, octadecyl, aryl decyl, etc. Further, the aryl groups expressed by $R_1$ and $R_2$ of the same formula are phenyl and nathtyl groups and the alkenyl groups expressed thereby are hexenyl, heptenyl and octadecynyl groups. These alkyl, alkenyl and aryl groups may have a single or a plurality of substituent groups. As the substituent groups for the alkyl and alkenyl groups, there are halogen atoms, alcoxyl, aryl, aryloxy, alkenyl and alcoxycarbonyl groups, and as substituents for the aryl group, there are, for example, halogen atoms, alkyl, alcoxyl, aryl, aryloxy, alkenyl and alcoxylcarbonyl groups. Two or more of substituent groups may be introduced into alkenyl or aryl group.

As phosphoric acid esters advantageously used in this invention, those expressed by the following general formula [II] may be given.

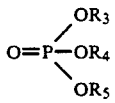

General formula [II]

wherein $R_3$, $R_4$ and $R_5$ independently designate an alkyl, an alkenyl or an aryl. However, it is preferable that the total number of carbon atoms of the groups expressed by $R_3$, $R_4$ and $R_5$ be in the range of 3–54.

In this invention, the alkyl groups expressed by $R_3$, $R_4$ and $R_5$ of the above-mentioned general formula [II] are straight chain or branching which are, for example, butyl, pentyl, nexyl, undecyl, dodecyl, tetradecyl, pentadecyl, hexadecyl, heptadecyl, octadecyl and nonadecyl groups.

These alkyl, alkenyl and aryl groups may have a single or a plurality of substituent groups. It is preferable that $R_3$, $R_4$ and $R_5$ are alkyl groups which are, for example, n-butyl, 2-ethylhexyl, n-octyl, 3, 5, 5-trimethylhexyl, n-nonyl, n-decyl, sec-decyl, sec-dodecyl and t-octyl groups.

As alkenyl groups, there are ethylene, aryl and butene groups and as aryl groups, there are phenyl, tolyl and xylyl groups.

The following are examples of high-boiling point organic solvents according to this invention each of which has a dielectric constant of 3.5 or more but the invention is not limited thereto.

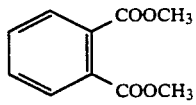

A-1

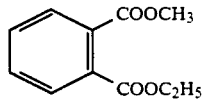

A-2

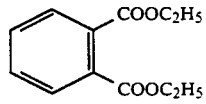

A-3

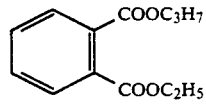

A-4

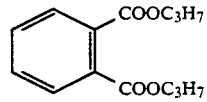

A-5

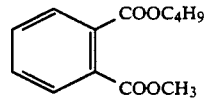

A-6

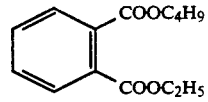

A-7

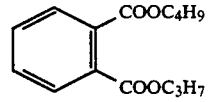

A-8

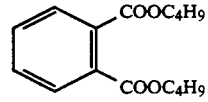

A-9

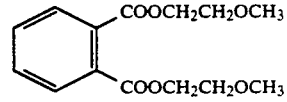

A-10

-continued
A-11
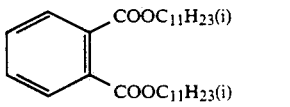
A-12
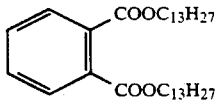
A-13
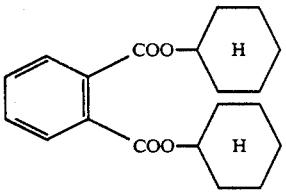
A-14
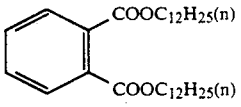
A-15
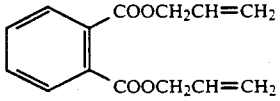
A-16
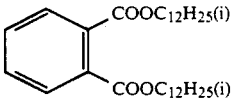
A-17
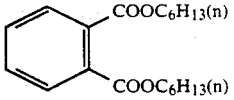
A-18
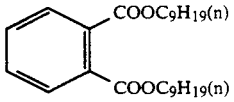
A-19
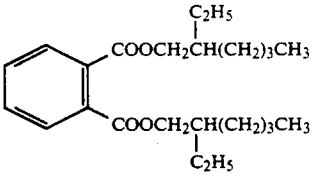
A-20
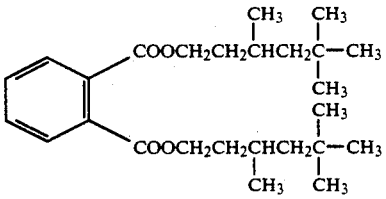
A-21
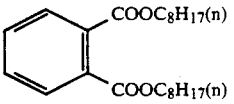
-continued
A-22
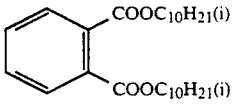
A-23
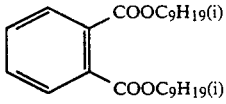
A-24
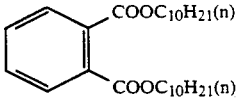
A-25
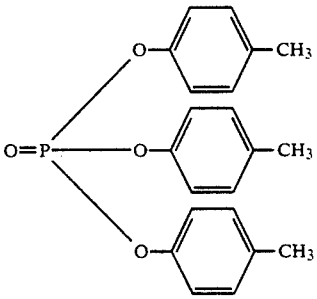
A-26
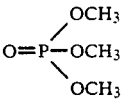
A-27
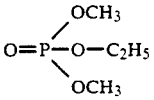
A-28
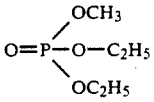
A-29
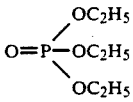
A-30
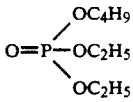
A-31
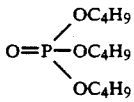
A-32
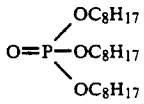
(A-33)
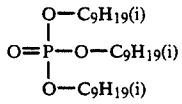

-continued

A-34

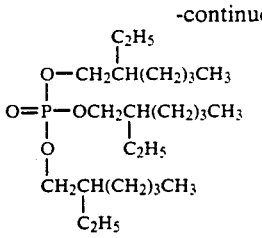

A-35

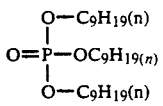

A-36

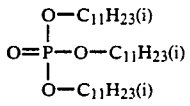

(A-37)

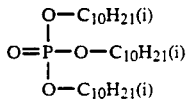

A-38

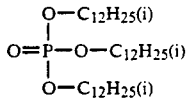

A-39

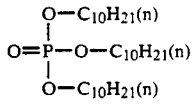

As the high-boiling point organic solvents according to this invention each having a dielectric constant of 3.5 or more, there are the following additional solvents such as malonic acid diethyl, mayeline acid diethyl, r-butyrolactone, benzoic acid methyl, benzilalcohol and 1-octanol.

These high-boiling point organic solvents according to this invention can be used together with known low-boiling point organic solvents such as acetic acid ether.

The pH of the non-rinsing stabilizing solution according to this invention is preferably in the range of 3.0–9.5 and it is preferable to adjust the pH to the range of 3.5–9.0 for the prevention of precipitation as one of the objects of this invention.

Further, as other chemical compounds which can be added to the non-rinsing stabilizing solution, there are organic acid salts (such as citric acid, acetic acid, succinic acid, oxalic acid, benzoic acid, etc.), pH buffer agents (such as phosphoric acid, borate, hydrochloric acid, phosphoric acid, etc.) or surface active agents, anticeptics, metallic salts such as Bi, Mg, Zn, Ni, Al, Sn, Ti, Zr, etc. The amount of addition of these compounds is optional provided that the pH of the non-rinsing stabilizing solution of this invention be maintained and they can be used in any combination among them unless they give adverse effects on the stability of the stability of color photographic image preservation and the prevention of precipitation.

In the process of stabilizing the photosensitive material of this invention, the processing temperature should preferably be in the range of 15° C.–50° C. and more preferably, be in the range of 20° C.–45° C. It is preferable that the processing time is as short as possible in view of speedy processing but it is usually in the range from 20 sec. to 10 minutes and the range between 1–5 minutes is the most preferable. In the case of stabilizing process by use of a plurality of stabilizing tanks, it is preferable that the time for processing by the first-stage tank be shorter than that by the next-stage tank and so on, and it is especially desirable that the processing time by the first-stage tank is shorter by 20–50% than the next-stage tank and so on.

In case the silver halide color photosensitive material according to this invention contains at least one of cyan couplers shown by the following general formula [VII-]-IX], the effect of the invention is more favorably displayed.

General formula [VII]

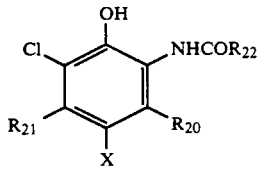

wherein one of $R_{20}$ and $R_{21}$ designates a hydrogen atom and the other designates a straight chain or branched alkyl group having 2–12 carbon atoms, X designates a hydrogen atom or a group capable of being split off upon coupling reaction with an oxidized product of a color developing agent and $R_{22}$ designates a ballasting group.

General formula [VIII]

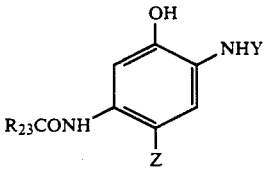

General formula [IX]

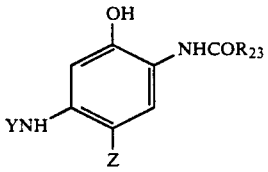

wherein Y designates $-COR_{24}$

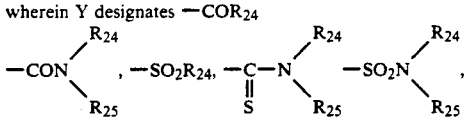

$-CONHCOR_{24}$ or
$-CONHSO_2R_{24}$ (provided that $R_{24}$ designates an alkyl group, alkenyl group, cycloalkyl group, aryl or heterocyclic group designates a hydrogen atom, alkyl, alkenyl, cycloalkyl groups, aryl or heterocyclic group and $R_{24}$ and $R_{25}$ may combine with each other to form a heterocycle of 5–6 members), $R_{23}$ designates a ballast group and Z designates a group capable of being split off upon reactions with an oxidation product of a color developing agent.

The cyan couplers according to this invention can be expressed by the above-mentioned general formulae [VII]-IX] which will now be described in further detail.

In this invention, the straight chain or branched alkyl group having 2–12 carbon atoms which are expressed by $R_{20}$ and $R_{21}$ of the general formula [VII] are, for example, ethyl, propyl and butyl groups.

In the general formula [VII], the ballast group expressed by $R_{22}$ is an organic group having such a size and shape as to give a coupler a sufficient volume to substantially prevent the coupler from scattering from the layer to which it is applied, to another layer. Typical of it is an alkyl or aryl group with total carbon atom number of 8–32 of which one having 13–28 carbons is preferable. These alkyl and aryl groups may have substituent groups and as such, there are, for example, alkyl group, aryl group, alcoxyl group, aryloxy group, carboxyl group, aryl group, ester group, hydroxy group, cyano group, nitro group, carbamoil group, cyano group, carboamide group, alkylthio group, arylthio group, sulfonamide group, sulfamoil group and halogen and as substituent groups for the alkyl group, there are those for the aryl group mentioned above with the exception of the aryl group.

Those that are preferable as belonging to the ballast group are expressed by the following general formula.

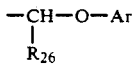

where in $R_{26}$ designates an alkyl group having 1–12 carbon atoms, Ar designates an aryl group such as phenyl group which may have substituent groups. As substituent groups, there are an alkyl group, hydroxy group, halogen atom, alkylsulfonamide group but a branching alkyl group such as a t-butyl alkyl group is the most preferable.

As is well known to a person with ordinary skill in the art, the group capable of separation through coupling with the oxide of a color developing agent defined by X in the above-mentioned general formula [VII] determines the equivalent of the coupler and controls the reactivity of coupling. As typical examples, there are halogen represented by chlorine and fluorine, aryloxy group, sulfonamide, arylthio, heteroilthio, heteroiloxy, sulfonyloxy and carbamoiloxy groups. More concrete examples are those given in the Japanese Laid-open Patent Publication Nos. 50-120334, 50-130414, 54-48237, 51-146828, 54-14736, 7-37425, 50-123341, 58-95345, Japanese Patent Publication No. 48-36894, U.S. Pat. Nos. 3,476,563, 3,737,316 and 3,227,551.

Next, examples of compounds of cyancouplers expressed by the general formula [VII] will be given hereunder though this invention is not limited thereto. In these compounds, $R_{21}$, X, $R_{22}$ and $R_{20}$ are specified as shown.

(Illustrated compounds)

| Coupler No. | $R_{21}$ | X | $R_{22}$ | $R_{20}$ |
|---|---|---|---|---|
| C-1 | $-C_2H_5$ | $-H$ | 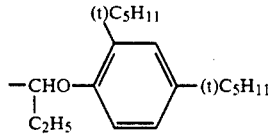 | $-H$ |
| C-2 | $-C_2H_5$ | $-Cl$ | 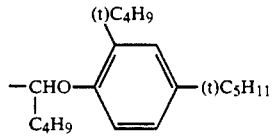 | $-H$ |
| C-3 | $-C_2H_5$ | $-H$ | 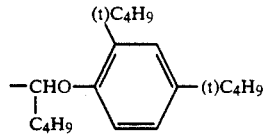 | $-H$ |
| C-4 | $-C_2H_5$ | $-Cl$ | 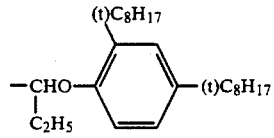 | $-H$ |
| C-5 | $-C_2H_5$ | $-Cl$ | 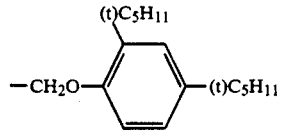 | $-H$ |
| C-6 | $-C_2H_5$ | 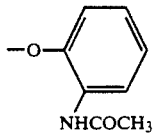 | 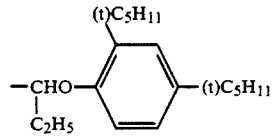 | $-H$ |

-continued (Illustrated compounds)

| Coupler No. | $R_{21}$ | X | $R_{22}$ | $R_{20}$ |
|---|---|---|---|---|
| C-7 | $-CH(CH_3)_2$ | $-Cl$ | $-CH(C_2H_5)-O-C_6H_3-C_{15}H_{31}(n)$ | $-H$ |
| C-8 | $-C_2H_5$ | $-Cl$ | $(t)C_5H_{11}$, $-CH(C_2H_5)-O-$, $(t)C_5H_{11}$ | $-H$ |
| C-9 | $-C_2H_5$ | $-Cl$ | $(t)C_5H_{11}$, $-CH(C_4H_9)-O-$, $(t)C_5H_{11}$ | $-H$ |
| C-10 | $-C_4H_9$ | $-F$ | $-CH(C_{12}H_{25})-O-$, $OH$, $(t)C_4H_9$ | $-H$ |
| C-11 | $-C_2H_5$ | $-F$ | $-CH(C_{12}H_{25})-O-$, $OH$, $(t)C_4H_9$ | $-H$ |
| C-12 | $-C_2H_5$ | $-Cl$ | $(t)C_5H_{11}$, $-(CH_2)_3O-$, $(t)C_5H_{11}$ | $-H$ |
| C-13 | $-C_2H_5$ | $-F$ | $(t)C_5H_{11}$, $-CHO-$, $(t)C_5H_{11}$ | $-H$ |
| C-14 | $-C_4H_9$ | $-Cl$ | $(t)C_5H_{11}$, $-CH(C_2H_5)-O-$, $(t)C_5H_{11}$ | $-H$ |
| C-15 | $-C_2H_5$ | $-Cl$ | $-CH(C_{12}H_{25})-O-$, $NHSO_2C_4H_9$ | $-H$ |
| C-16 | $-C_2H_5$ | $-Cl$ | $Cl$, $-CH(C_{12}H_{25})-O-$, $Cl$, $Cl$ | $-H$ |

-continued (Illustrated compounds)

| Coupler No. | $R_{21}$ | X | $R_{22}$ | $R_{20}$ |
|---|---|---|---|---|
| C-17 | $-CH(CH_3)_2$ | $-Cl$ | $-C_{18}H_{37}$ | $-H$ |
| C-18 | $-C_2H_5$ | $-F$ | 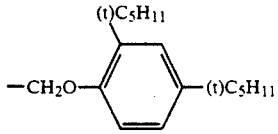 | $-H$ |
| C-19 | $-C_2H_5$ | 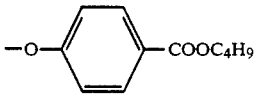 | 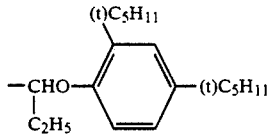 | $-H$ |
| C-20 | $-C_2H_5$ | $-Cl$ | 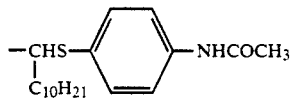 | $-H$ |
| C-21 | $-C_3H_7$ | $-Cl$ | 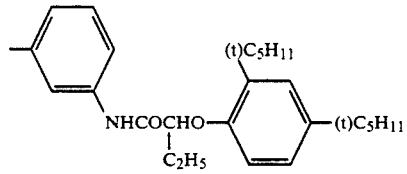 | $-H$ |
| C-22 | $-C_3H_7$ | $-Cl$ | 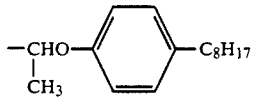 | $-H$ |
| C-23 | $-C_2H_4NHCOCH_3$ | $-Cl$ | 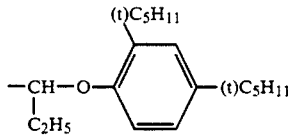 | $-H$ |
| C-24 | $-C_3H_6OCH_3$ | $-Cl$ | 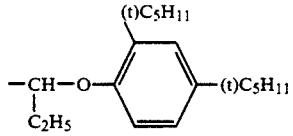 | $-H$ |
| C-25 | $-H$ | $-Cl$ | 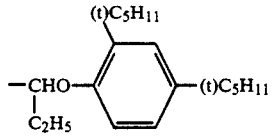 | $-C_2H_5$ |
| C-26 | $-H$ | $-Cl$ | | $-C_3H_7$ |
| C-27 | $-H$ | $-Cl$ | | $-C_5H_{11}$ |
| C-28 | $-C_2H_5$ | $-Cl$ | 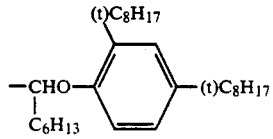 | $-H$ |

The methods of synthesizing the chemical compounds illustrated in this invention will now be described hereunder but other compounds can be synthesized by the same methods.

Example of synthesization of Compound C-5

[(1)-a] Synthesization of 2 -nitro-4.6- dichloro-5-ethyl phenol 33 g of 2-nitro-5-ethylphenol, 0.6 g of iodine and 1.5 g of ferric chloride were dissolved in 150 ml of glacial acetic acid and 75 ml of sulfuryl chloride was dropped into the solution for three hours at 40° C. The precipitate generating during the above process was refluxed into the solution by heating after the sulfuryl chloride has been dropped so as to make the precipitate dissolved in the solution by reactions. It took about two hours for refluxing the precipitate. Then the reacted solution was poured into water to generate crystals and the crystals were refined by recrystallization with methanol. The confirmation of (1)-a was made by a nuclearmagnetic resonance spectrograph and element analysis.

[(1)-a] Synthesization of 2-nitro-4, 6-dichloro-5-ethylphenol 21.2 g of the compound of [(1)-a] was dissolved in 300 ml of alcohol, a catalytic amount of Raney nickel was added to the solution and hydrogen was passed through the solution at normal temperature until no more hydrogen was absorbed. After the reaction, the Raney nickel was removed and retained by pressure reduction with alcohol. The residual [(1)-b] is acylated without being refined.

[(1)-c] Synthesization of 2[2.4 -ji-tert-acylphenoxy) acetoamide 1-4, 6-dichloro-5-ethylphenol 18.5 g of crude amide obtained by [(1)-b] was dissolved in a mixture of 500 ml of glacial acetic acid and 16.7 g of acetic acid soda and an acetic acid solution prepared by dissolving 28.0 g of 2.4 -di-tert-acylphenoxyacetic acid chloride in 50 ml of acetic acid was dropped into the first-mentioned solution at room temperature for 30 minutes and after agitating the solution for 30 minutes, the reacted solution was poured into glacial water. After that, the resultant precipitate was filtered and after drying, it was recrystallized twice thereby obtaining a desired product. The confirmation of the desired product was performed by an element analysis and nuclear magnetic resonance spectrograph.

| | $C_{21}H_{25}NO_3Cl$ | | | |
|---|---|---|---|---|
| | C | H | N | Cl |
| Calculated value (%) | 65.00 | 7.34 | 2.92 | 14.76 |
| Measured value (%) | 64.91 | 7.36 | 2.99 | 14.50 |

Next, the cyan couplers expressed by the general formula [VIII] or [IX] and used in this invention will be described. In the general formulae [VIII] and [IX], Y designates a group expressed by

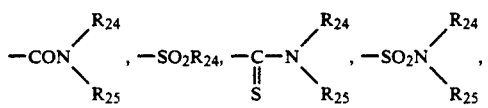

$-CONHCOR_{24}$, or $-CONHSO_2R_{24}$ provided that $R_{24}$ designates an alkyl group, preferably one having 1-20 carbon atoms (such as methyl, ethyl, t-butyl and dodecyl groups), alkenyl group preferably one that has 2-20 carbon atoms such as an aryl group or heptadecenyl group, etc.), cycloalkyl group, preferably of 5-7 member cycle (for example, cyclohexyl), aryl groups (for example, phenyl, tryl and naphthyl groups), heterocyclic group of 5-6 member cycles including 1-4 nitrogen, oxygen or sulphur atoms (such as furil, thienyl, benzothiazoril groups, etc.). $R_{25}$ designates a hydrogen atom or a group expressed by $R_{24}$, $R_{24}$ and $R_{25}$ may combine with each other to form a heterocycle of 5-6 members. Further, $R_{22}$ and $R_{23}$ may be introduced with desired substituent groups. For example, alkyl group of 1-10 carbon atoms (for example, methyl, i-propyl, i-butyl, t-butyl and t-octyl groups), aryl groups such as phenyl and naphthyl groups), halogen atoms (fluoride, chloride, bromine), cyano, nitro, sulfonamide groups (for example, methanesulfonamide, butansulfonamide, p-truensulfonamide, etc.), sulffamoil group (for example, methylsulfamoil, phenylsulfamoil, etc.), sulfonyl group (for example, methanesulfonyl, p-truensulfonyl, etc.), fluorosulfonyl group, carbamoil group (for example, dimethyl carbamoil, phenyl carbamoil, etc.), oxylcarbonyl group (for example, pyridyl and pyrazolyl group) alcoxy group, aryloxy group and acryloxy group.

In the general formulae [VIII] and [IX], $R_{23}$ designates a ballast group required for giving an anti-scattering property to the cyan coupler expressed by the general formulae [VIII] and [IX] and the cyan pigment formed by the cyan coupler. Preferably, an aryl group having 4-30 carbon atoms, aryl group or heterocyclic group. For example, straight chain or branching alkyl groups (such as t-butyl, n-octyl, t-octyl, n-dodecyl, etc.), alkenyl group, cycloalkyl group and 5-6 members heterocyclic group.

In the general formulae [VIII] and [IX], Z designates a group capable of separation at the time of coupling reaction against hydrogen atoms or oxide of a N-hydroaxyalkyl substituent -p-phenylene diamine derivative developing agent. For example, halogen atoms (such as chlorine, bromine, fluorine, etc.), substituted or non-substituted alcoxyl group, aryloxy group, heterocyclic oxy group, acyloxy group, carbamoiloxy group sulfonyloxy group, alkylthio group, arylthio group heterocyclic thio group and sulfonamide group and as more concrete examples, there are U.S. Pat. No. 3,741,563, Japanese Laid-open Patent Publication No. 47-37425, Japanese Patent Publication No. 48-36894, Japanese Laid-open Patent Publications Nos. 50-10135, 50-117422, 50-130441, 51-108841, 50-120343, 52-18315, 53-105226, 54-14736, 54-48237, 55-32071, 55-65957, 56-1938, 56-12643, 56-27147, 59-146050, 59-166956, 60-24547, 60-35731 and 60-37557.

In this invention, of the cyan couplers expressed by the general formula [VIII] or [IX], those expressed by the following general formula [X], [XI] or [XII] are more preferable.

General formula [X]

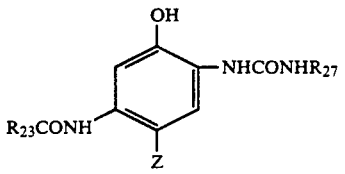

-continued

General formula [XI]

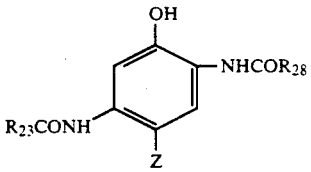

General formula [XII]

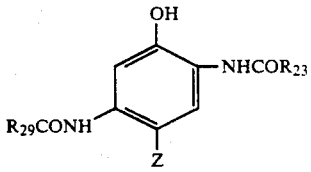

In the general formula [X], $R_{27}$ designates a substituted or non-substituted aryl group (preferably, phenyl group). As a substituent group, at least a substituent group selected from $SO_2R_{30}$, halogen atoms (fluorine, chlorine and bromine, $—CF_3$, $—NO_2$, —CN, $—COR_{30}$, $—COOR_{30}$, $—SO_2RO_{30}$,

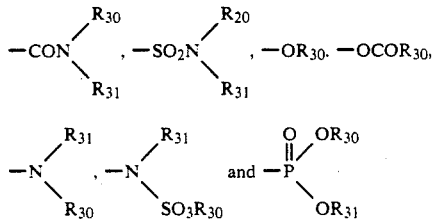

is included.

In this case, $R_{30}$ designates an alkyl group, preferably one having 1-20 carbon atoms (such as methyl, ethyl, tert-butyl and dodecyl groups), alkenyl, preferably one having 2-20 carbon atoms (such as aryl, heptadecenyl groups, etc.), cycloalkyl group, preferably 5-7 member cyclic group (for example, cyclohexy), aryl group (for example, phenyl, tril, naphthyl groups, etc.). $R_{31}$ designates a hydrogen atom or a group expressed by $R_{30}$ The above-mentioned $R_{90}$, $R_{31}$, and $R_{28}$, and $R_{29}$ of the general formulae [XI] and [XII] may be introduced with desired further substituent groups. To be more concrete, these substituent groups are those that can be introduced into $R_{24}$ or $R_{25}$ in the general formulae [VIII] and [IX] and halogen atoms (chlorine atoms, fluorine atoms, etc.) are especially preferable.

The Z and $R_{23}$ in the general formula [X], [XI] or XII] have the same meaning as the general formulae [VIII] and [IX], respectively. Examples of ballast groups expressed by $R_{23}$ are those expressed by the following general formula [XIII].

General formula [XIII]

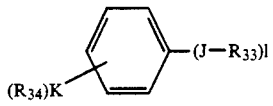

wherein J designates an oxygen or sulfur atom or a sulfonyl group, K designates an integer of 0-4, 1 designates 0 or 1, and when more than two Ks are present, more than two Rs may be the same or different.

$R_{34}$ designates a straight chain or branching alkylene group having 1-20 carbon atoms or substituted aryl group and $R_{33}$ designates a monovalent group, preferably a hydrogen atom, a halogen atom (such as chrome and bromine), alkyl group, preferably a straight chain or branching alkyl group having 1-20 carbon atoms (such as methyl, t-butyl, t-pentyl, t-octyl, dodecyl, pentadecyl, benzil and phenetil groups), aryl group (such as phenyl, heterocyclic groups), alcoxyl group, preferably a straight chain or branching alcoxyl group having 1-20 carbon atoms (such as methoxy, ethoxy, t-butyloxy, octyloxy, decyloxy and dodecyl oxy groups), aryloxy group, (such as phenoxy group), hydrooxy and acyloxy groups, preferably alkylcarbonyloxy group, arylcarbonyl oxy group (such as acetoxy and benzoiloxy groups), carboxy and arylcarbonyloxy group, preferably a straight chain or branching alkylcarbonyl group, preferably a phenoxycarbonyl group, alkylthio group, preferably an acyl group having 1-20 carbon atoms, preferably a straight chain or branching alkylcarbonyl group having 1-20 carbon atoms, preferably a straight chain or branching alkylcarboamide group, benzoncarboamide group, sulfonamide group, preferably a straight chain or branching alkylsulfonamide group or benzosulfonamide group, carbamoil group, preferably a straight chain or branching alkylaminocarbonyl group or phenylaminocarbonyl group, sulfamoil group, preferably a straight chain or branching alkylaminosulfonyl or phenylaminosulphonyl group.

Next, concrete examples of cyan couplers expressed by the general formula [VIII] or [IX] will be shown but the invention is not limited thereto.

[Illustrated Compounds]

C-29

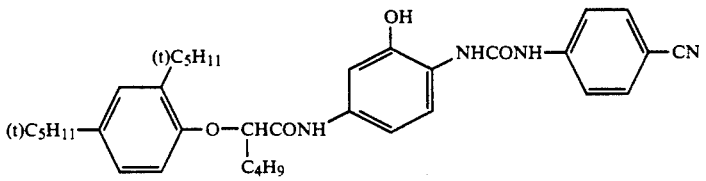

-continued
[Illustrated Compounds]
C-30
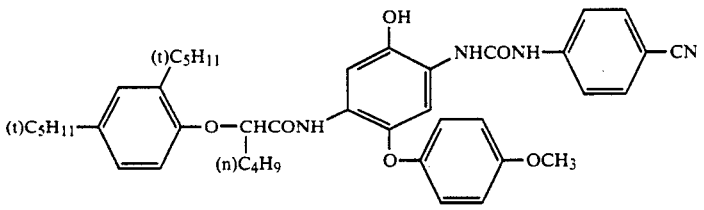
C-31
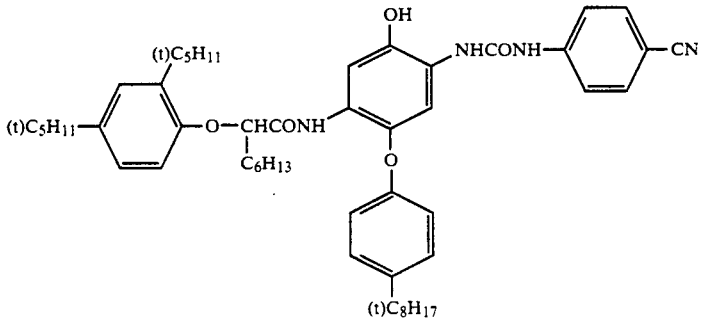
C-32
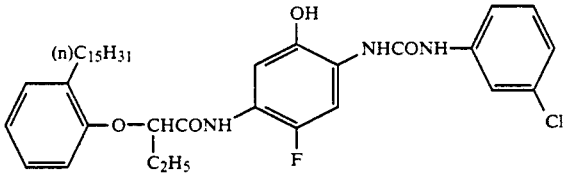
C-33
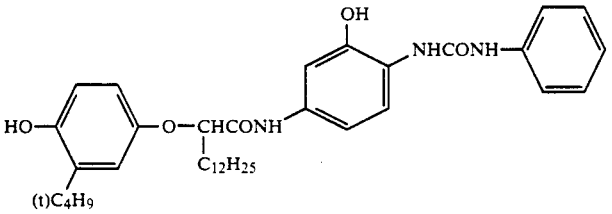
C-34
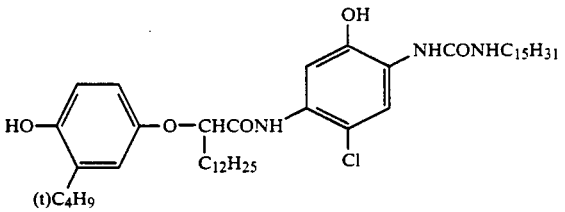
C-35
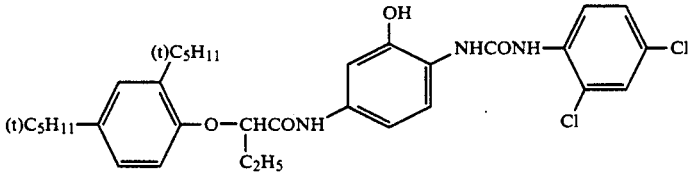
C-36
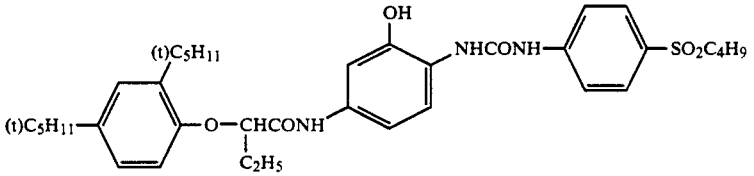

-continued
[Illustrated Compounds]
C-37
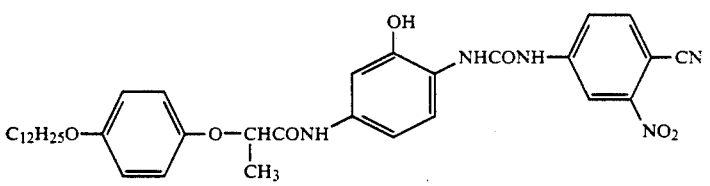
C-38
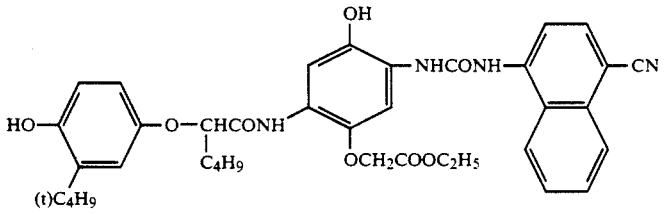
C-39
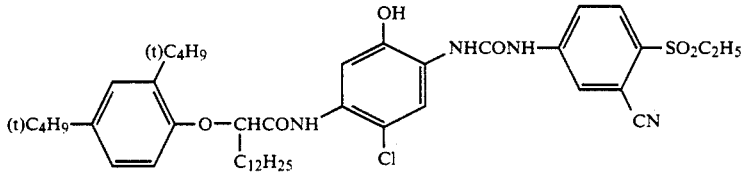
C-40
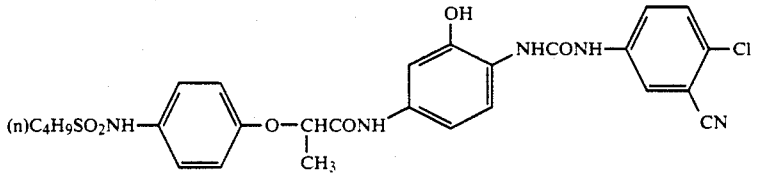
C-41
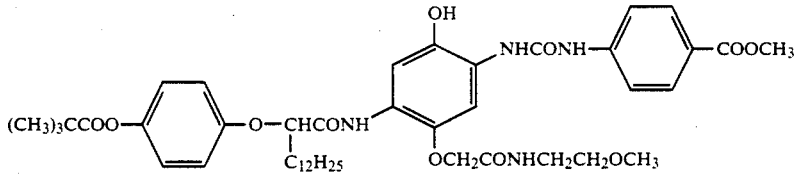
C-42
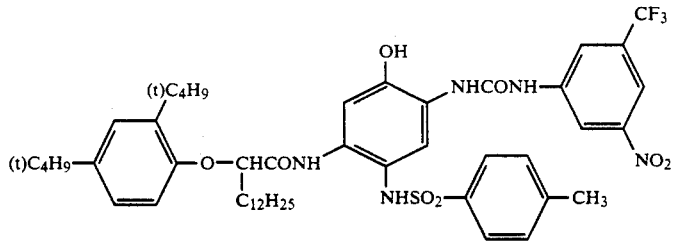
C-43
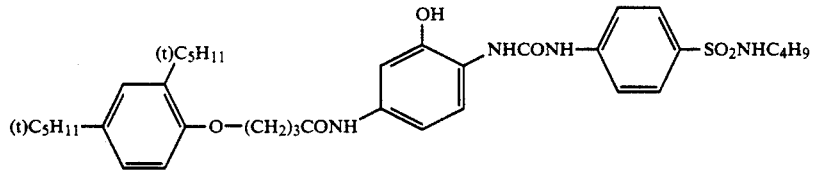
C-44
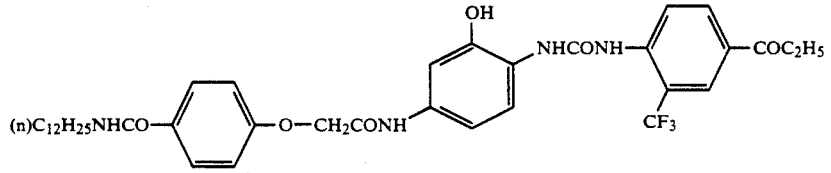

-continued
[Illustrated Compounds]
C-45
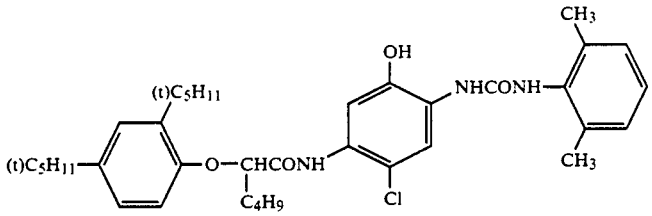
C-46
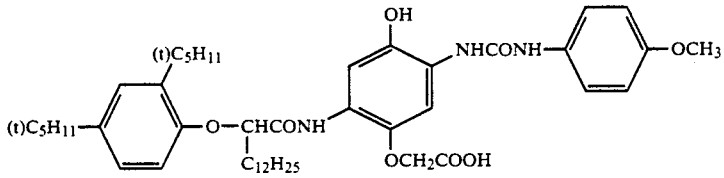
C-47
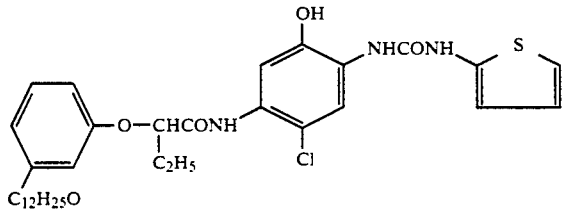
C-48
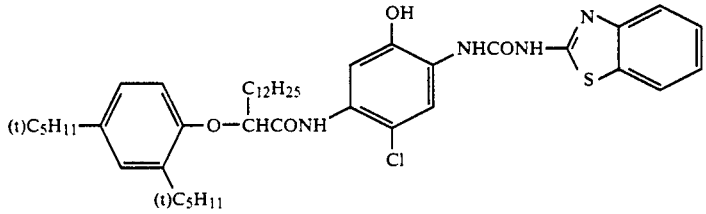
C-49
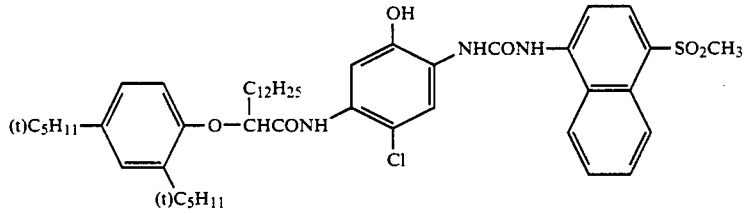
C-50
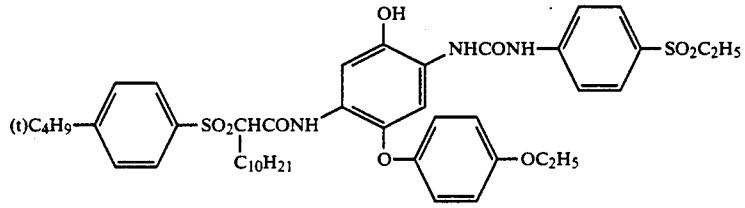
C-51
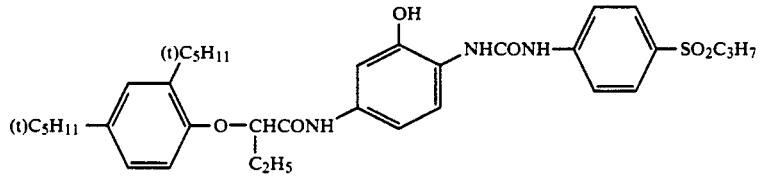

-continued
[Illustrated Compounds]
C-52
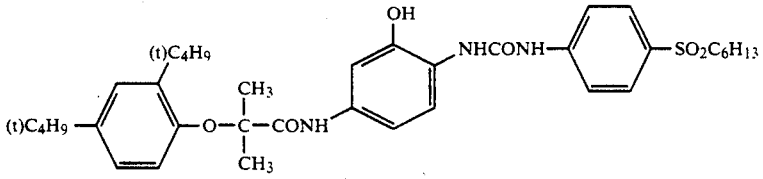
C-53
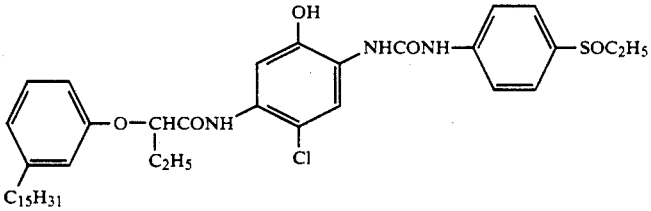
C-54
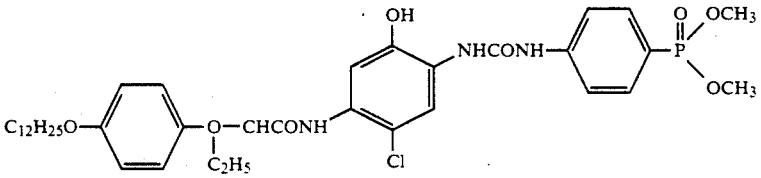
C-55
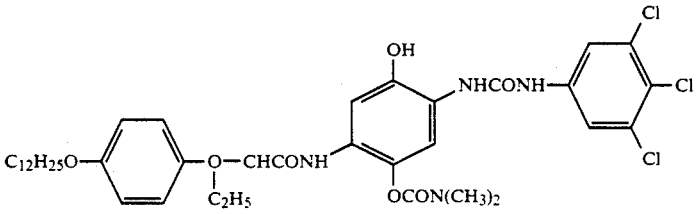
C-56
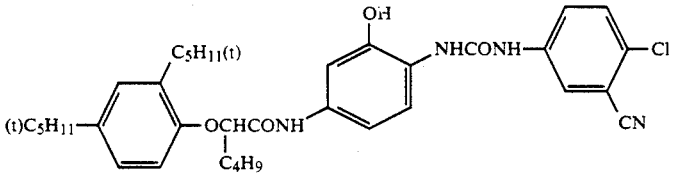
C-57
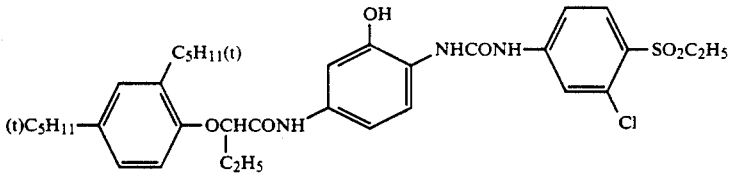
C-58
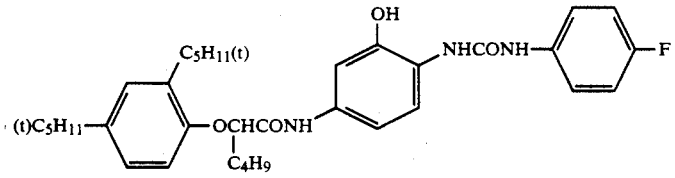
C-59
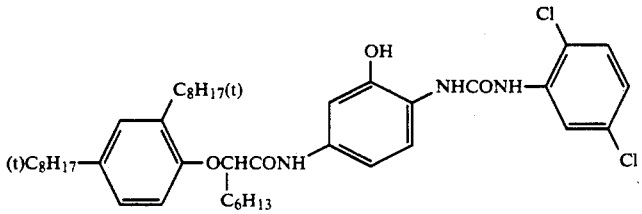

-continued
[Illustrated Compounds]
C-60
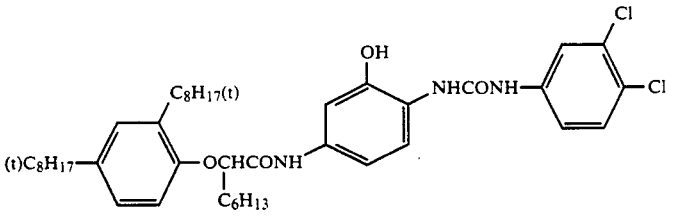
C-61
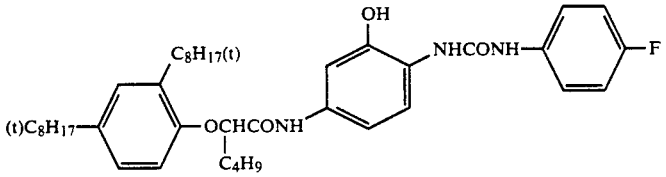
C-62
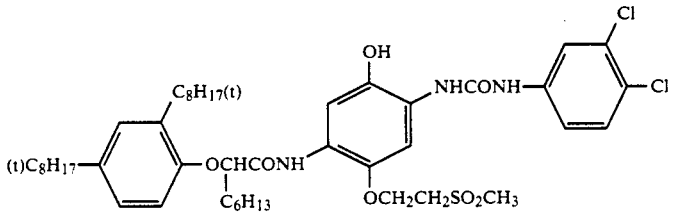
C-63
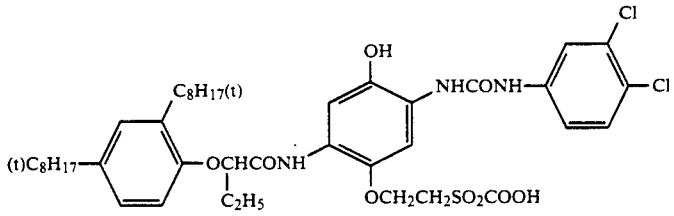
C-64
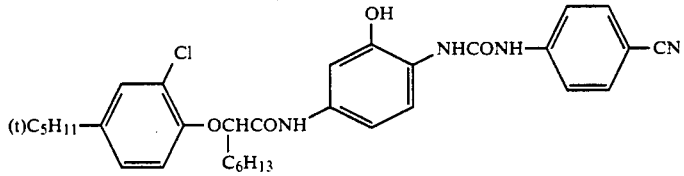
C-65
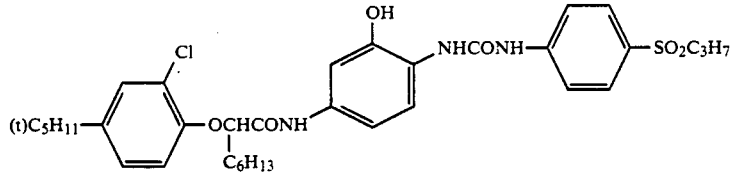
C-66
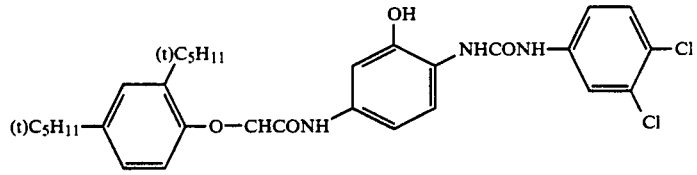
C-67
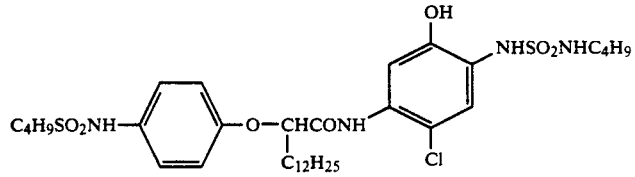

-continued
[Illustrated Compounds]
C-68
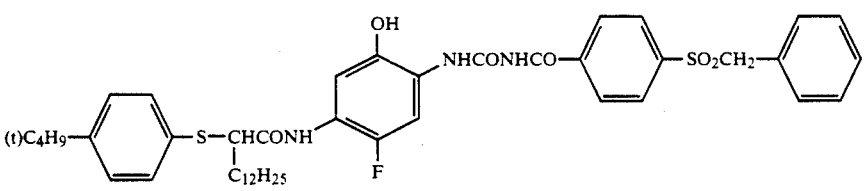
C-69
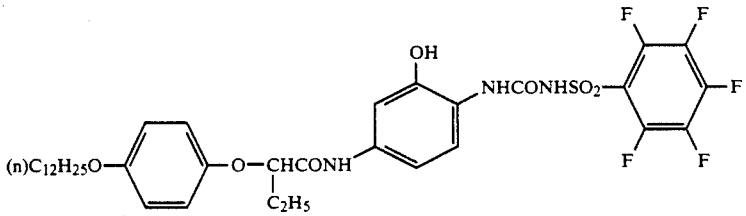
C-70
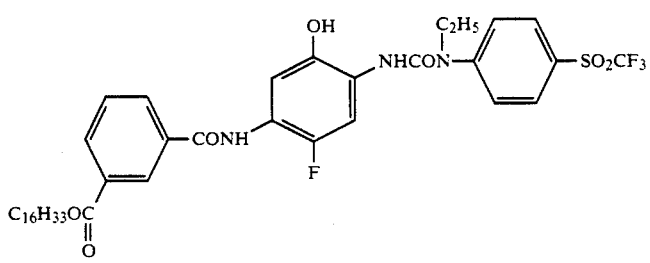
C-71
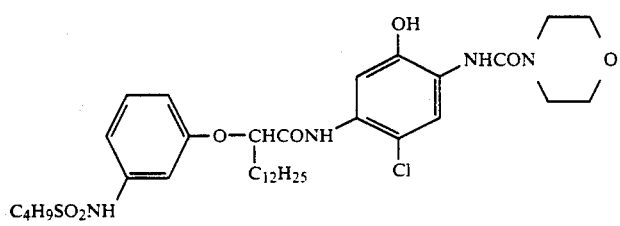
C-72
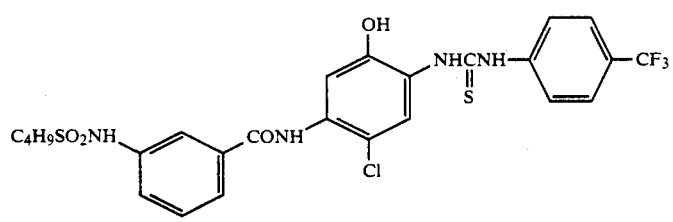
C-73
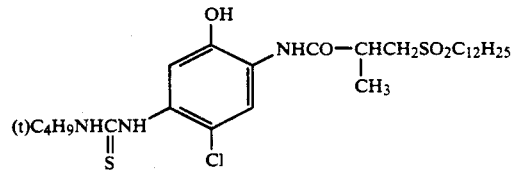
C-74
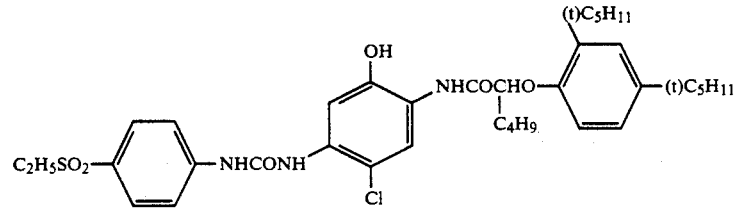

-continued
[Illustrated Compounds]
C-75
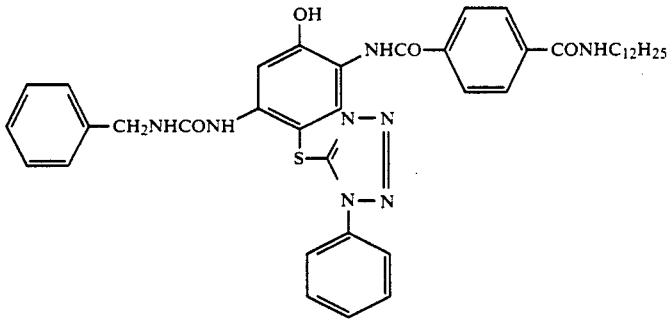
C-76
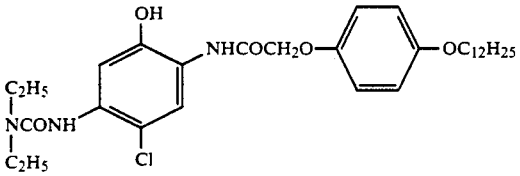
C-77
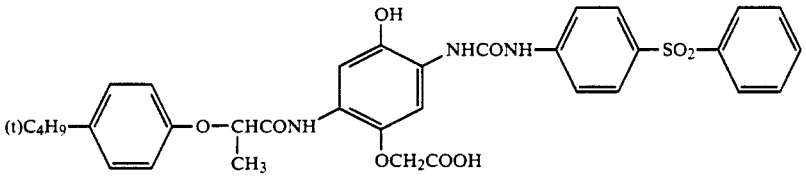
C-78
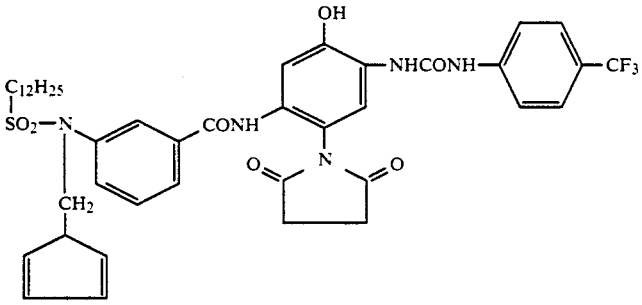
C-79
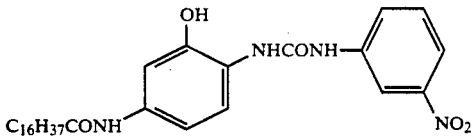
C-80
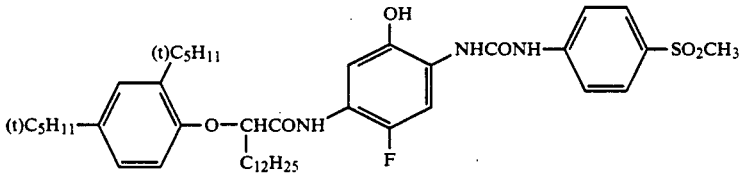
C-81
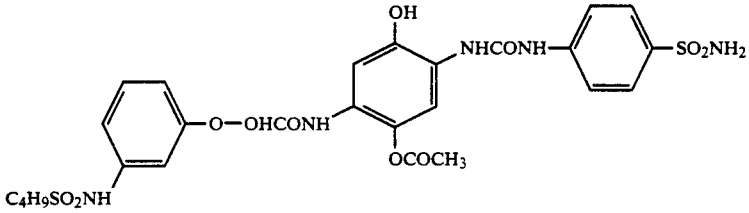

-continued
[Illustrated Compounds]
C-82
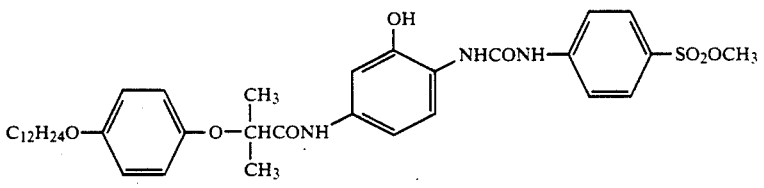
C-83
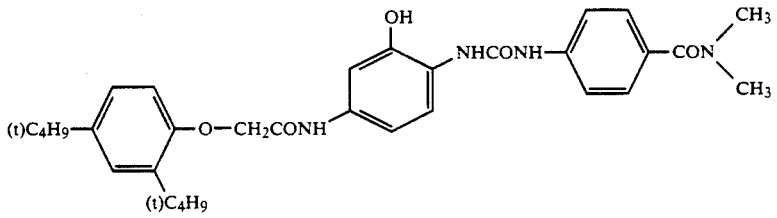
C-84
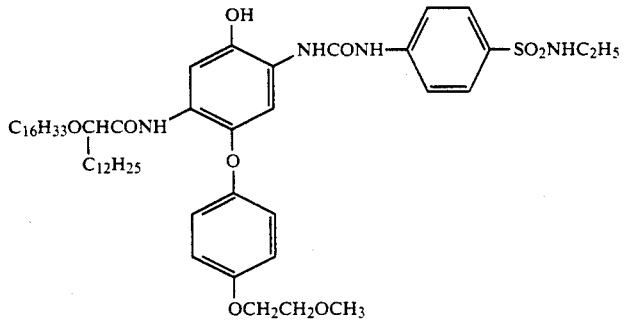
C-85
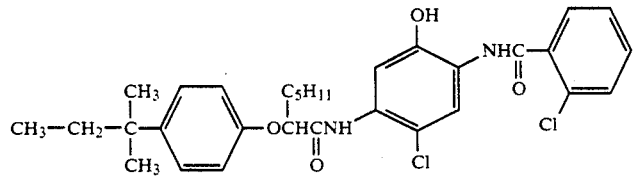
C-86
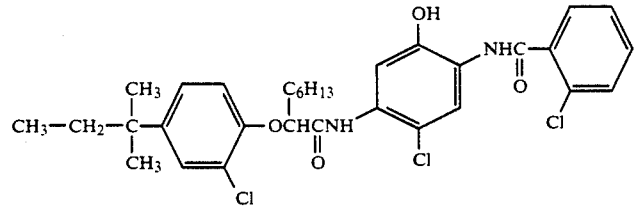
C-87
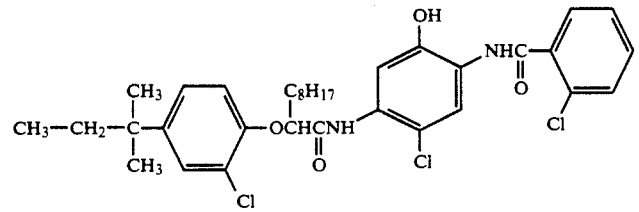
C-88
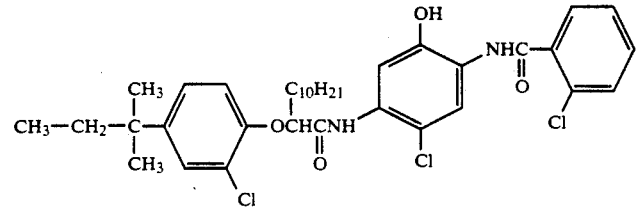

-continued
[Illustrated Compounds]
C-89
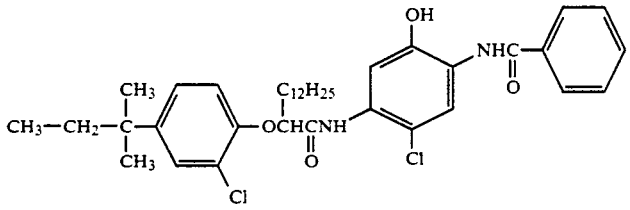
C-90
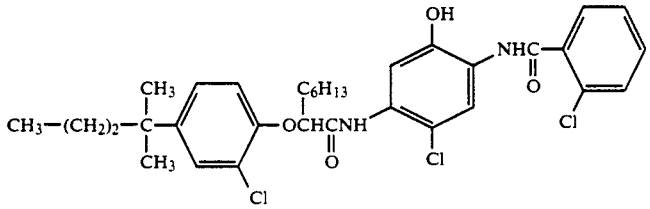
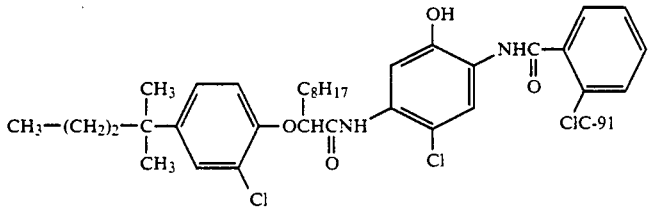
C-91
C-92
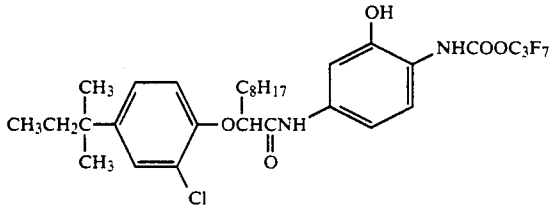
C-93
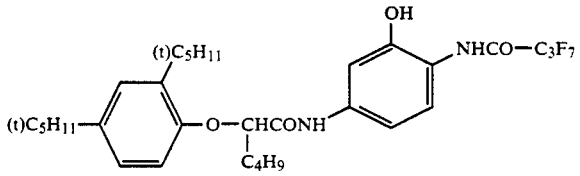
C-94
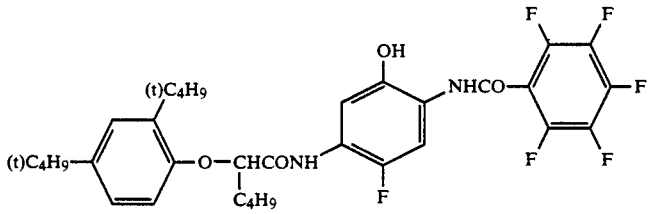
C-95
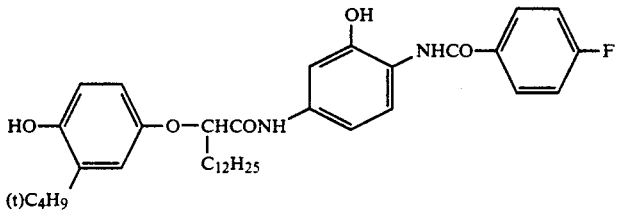

-continued
[Illustrated Compounds]
C-96
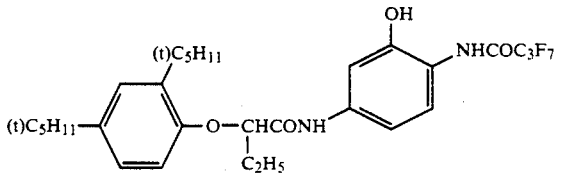
C-97
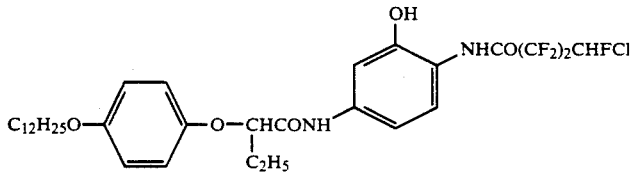
C-98
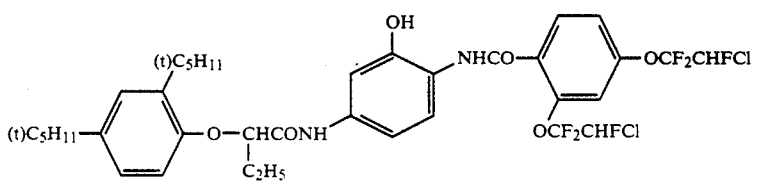
C-99
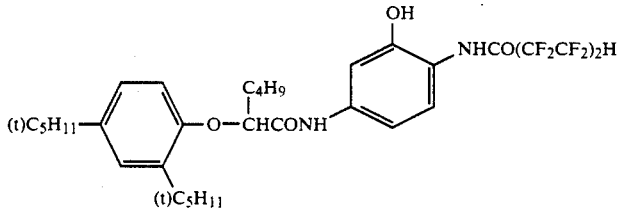
C-100
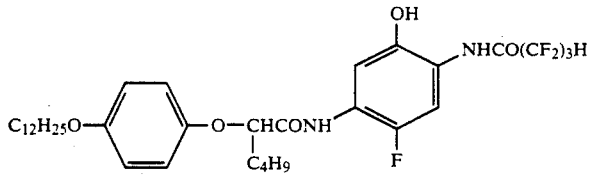
C-101
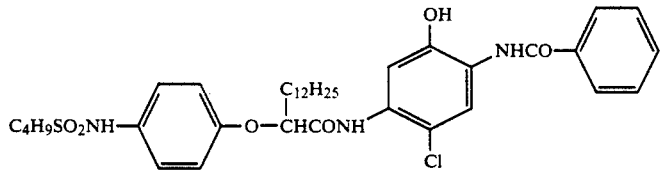
C-102
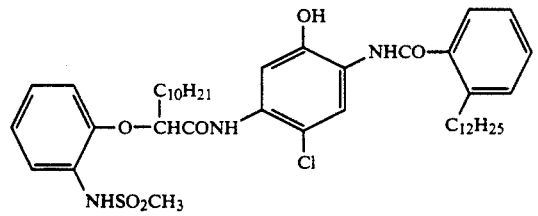
C-103
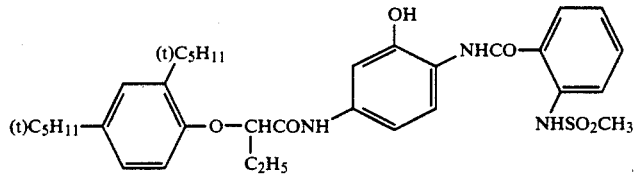

-continued
[Illustrated Compounds]
C-104
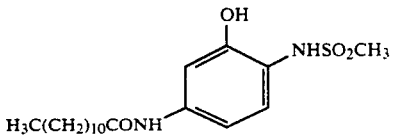
C-105
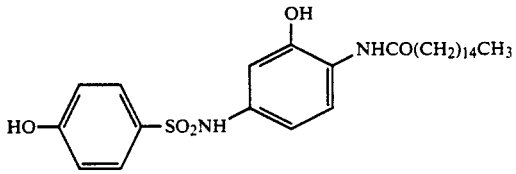
C-106
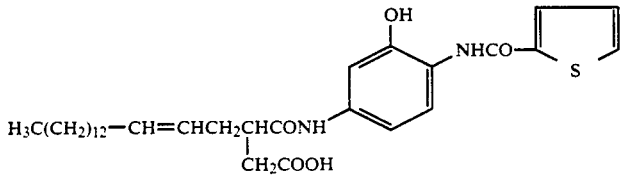
C-107
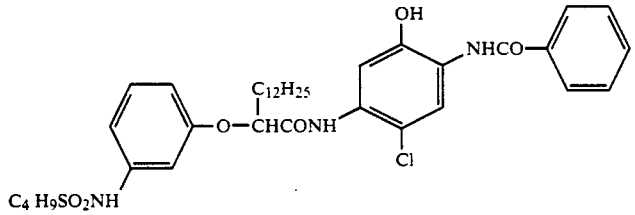
C-108
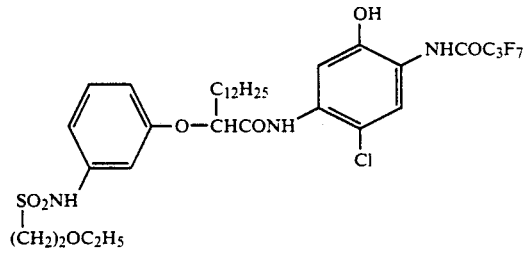
C-109
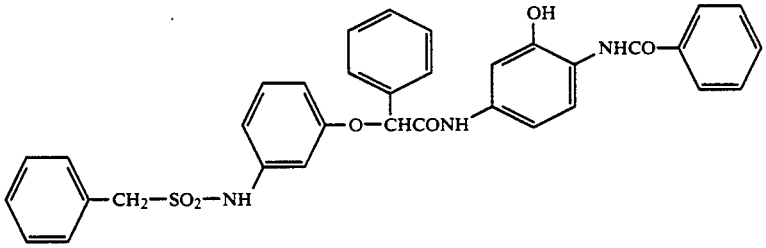
C-110
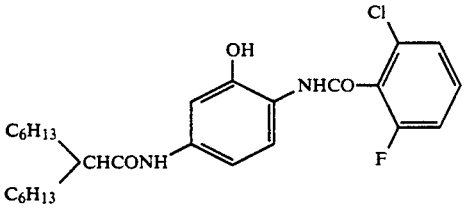

-continued
[Illustrated Compounds]
C-111
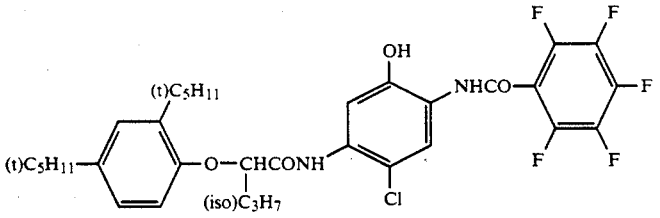
C-112
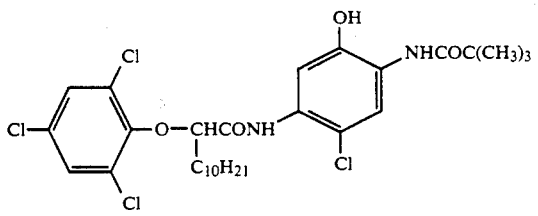
C-113
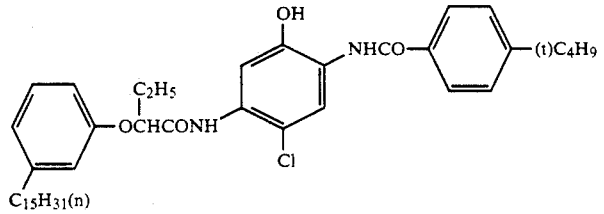
C-114
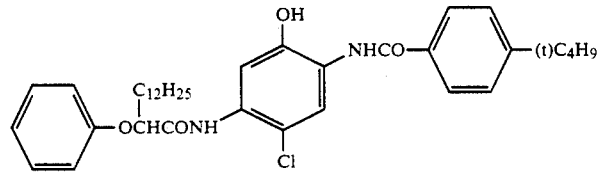
C-115
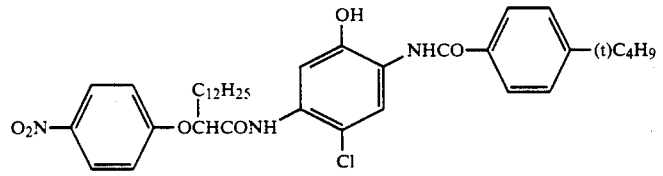
C-116
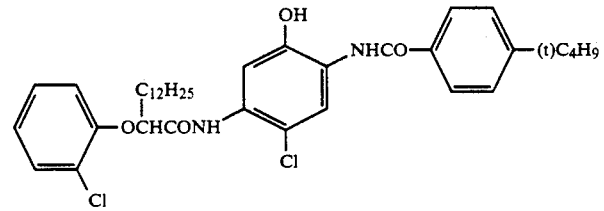
C-117
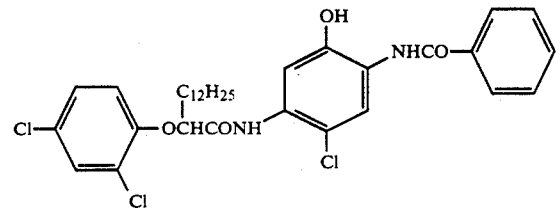

-continued
[Illustrated Compounds]
C-118
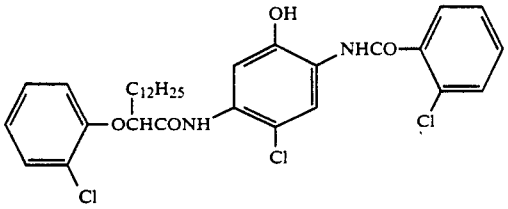
C-119
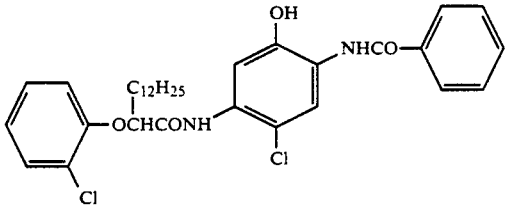
C-120
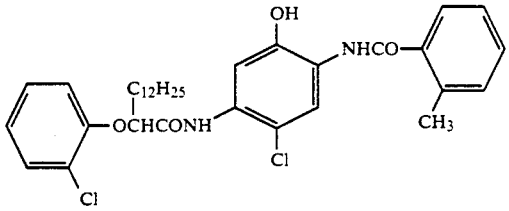
C-121
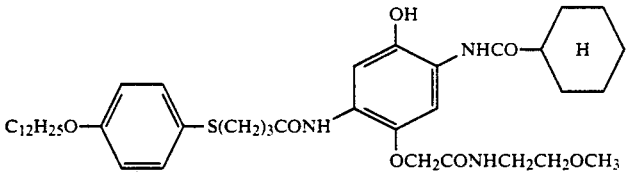
C-122
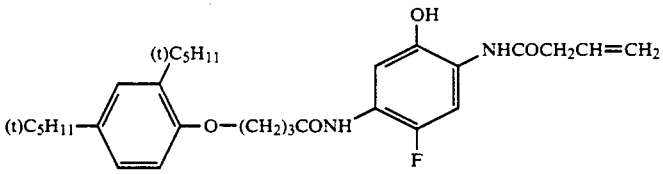
C-123
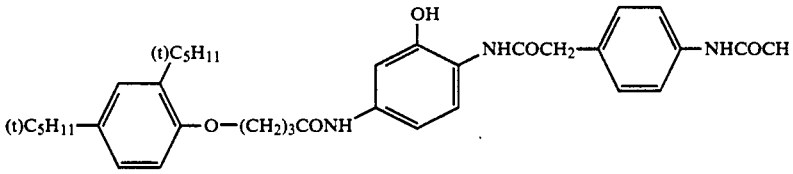
C-124
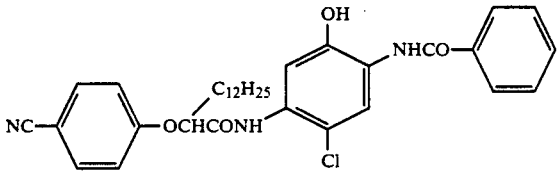

-continued

[Illustrated Compounds]

C-125

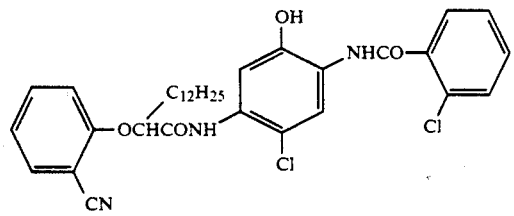

C-126

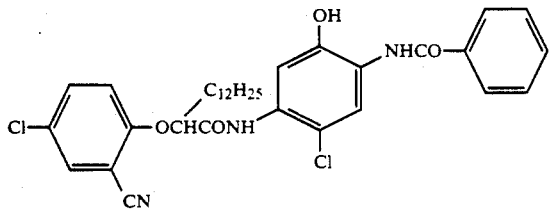

C-127

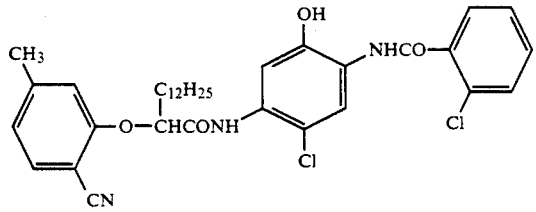

The cyan couplers preferably used in this invention can be synthesized according to known methods and in the cases of the compounds expressed by the general formula [VIII], for example, they can be synthesized by the methods described in, for example, U.S. Pat. Nos. 3,222,176, 3,446,622 and 3,996,253 and British Patent No. 1,011,940. Further, in the cases of compounds expressed by the general formula [IX], they are synthesized by the methods described in, for example, by U.S. Pat. Nos. 2,772,162, 3,758,308, 3,880,661 and 4,124,396; British Patent Nos. 975,773, 8,011,693 and 8,011,694; Japanese Laid-open patent Nos. 47-21139, 50-112038, 55-163537, 56-29235, 55-99341, 56-116030, 52-67327, 56-55945, 56-80045 and 50-134644; British Patent No. 1,011,940; U.S. Pat. Nos. 3,446,622 and 3,996,253; Japanese Laid-open Patent Publication Nos. 56-65134, 57-204543, 57-204544 and 57-204545; Japanese Patent Application Nos. 56-131309, 56-131311, 56-131312, 56-131313, 56-131314, 56-130459 and 57-149791 and Japanese Laid-open Patent Nos. 59-146050, 59-166956, 60-24547, 60-35731 and 60-37557.

The cyan couplers expressed by the general formula [VII], [VIII] or [IX] can be used in combination with the others than those of this invention in the range not contradicting the objects of this invention. Further, it is possible to use one or more than two of the cyan couplers expressed by the general formulae [VII], [VIII] and [IX].

When the cyan couplers of this invention expressed by the general formulae [VII]–[IX] are to be contained in a silver halide emulsion layer, they are in general used in about 0.005 to 2 mol, preferably 0.01 to 1 mol per 1 mol of a silver halide.

The silver halide halogen emulsions which can be used in this invention, may include any of silver chloride, silver bromide, silver iodide, silver chlorobromide, silver chloriodide silver iodobromide or silver chloriodobromide.

The silver halide color photosensitive materials of the invention may contain other various kinds of photographic additives. For example, anti-foggants, stabilizing agents, ultraviolet ray absorbents, anti-color-staining agents, brightening agents, anti-discoloring agents, anti-static agents, hardeners, surface active agents, plasticizers and wetting agents such as those described in Research Disclosure No. 17643. In the case of the silver halide color photosensitive materials of this invention, hydrophilic colloids may include synthesized hydrophilic high polymers of a single or copolymer such as gelatin, derivative gelatin, graft polymer of gelatin and other polymers, protein such as albumin and casein, cellulose derivatives such as hydroxyethylcellulose and carboxymethyl cellulose, starch derivatives, polyvinyl alcohol, polyvinyl imidazol and polyacrylamide.

As the supports for the silver halide color photosensitive material according to this invention, there are baryta paper, polyethylene-coated paper, polypropylene synthesized paper, a transparent support attached with a reflecting layer or using a reflecting body, for example, glass plates, polyester films such as polyethylene terephthalate films, polyamide films, polycarbonate films, polystyrene films, cellulose acetate films, cellulose nitrate films or other usual transparent support. These supports are suitably selected according to the purpose of using the photosensitive material.

Silver halide emulsion layers and other photographic component layer are coated in various coating methods such as dipping, air doctor coating, curtain coating and hopper coating and it is also possible to use the simultaneous coating method which performs coating of two and more layers simultaneously as described in U.S. Pat. Nos. 2,761,791 and 2,941,898.

In this invention, it is possible to determine the coating position of each emulsion layer at will. For example, in the case of a paper photosensitive material for full color print, it is preferable to arrange a blue-sensitive silver halide emulsion layer, green-sensitive silver halide emulsion layer and red sensitive emulsion layer in that order from the support side. Further, each of these silver halide emulsion layers may comprises two component layers and more.

In the case of the photosensitive material according to this invention, it is optional to provide an intermediate layer of a suitable thickness depending on purposes and also to use as a component layer, an anti-curling layer, a protective layer, an anti-halation layer, etc. in suitable combinations. For these component layers, it is possible to use hydrophilic colloids available for the above-mentioned emulsion layer as binding agents.

As photosensitive materials to which this invention is applicable, there are color paper, reversal paper, color negative films, color positive films, direct positive films and diffusion transfer photosensitive material.

EXAMPLES

This invention will be described in detail according to the preferred embodiments though the invention is not limited thereto.

Example 1

An anti-halation layer and a gelatin layer were provided on a triacetate film base and a red sensitive silver halide emulsion layer, a green sensitive silver halide emulsion layer, a filter layer containing yellow colloidal silver and a blue sensitive silver halide emulsion layer with the total amount of silver in the order of 62 mg per 100 $cm^2$ were coated on the film base. The above-mentioned emulsion layers contain silver iodobromide with about 4.8 mol % silver iodide. In this case, α-(4-nitrophenoxy)-α-pivalyl-5-[γ-2,4-di-t-aminophenoxy) butylamide] -2-chloroacetoanilide as a yellow coupler was used in the blue sensitive silver halide emulsion layer, 1-(2,4,6-trichlorophenyl) -3- [α-(2,4-di-t-aminophenoxy)-acetamide] benzamide -3-pyrazolone and 1-(2,4,6-trichlorophenyl) -3- [α-(2,4-di-t-amylphenoxy -acetamide] benzamide -4-(4-methoxyphenylazo)-5-pyrazolone as a magenta coupler was used in the green sensitive silver halide emulsion layer and as a cyan coupler, the following (C-i) was used in the red sensitive silver halide emulsion layer. In addition, usual additives such as a sensitizer, a hardening agent and the like were added to each emulsion layer provided that as a high-boiling point solvent, the illustrated compound (A-25) (having a dielectric constant of 7.5) was used. The silver halide color photosensitive material thus obtained was made a film sample (1) and the like film sample (2) was prepared by use of fluidized paraffin (having a dielectric constant of 2.2) instead of the high-boiling point solvent (A-25).

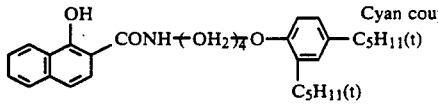

Cyan coupler (C-i)

This sample was subjected to stepwise exposure with white light by using a KS-7 type sensitometer (a product of Konishiroku Photo Industry Co., Ltd.) and was treated in the following steps.

| Processing steps (38° C.) | Number of tanks | Processing time |
|---|---|---|
| Color development | 1 | 3 min. 15 sec. |
| Bleaching | 1 | 4 min. 20 sec. |

-continued

| Processing steps (38° C.) | Number of tanks | Processing time |
|---|---|---|
| Fixation | 1 | 3 min. 10 sec. |
| Non-rinsing stabilizing solution (Cascade) | 2 | 1 min. 20 sec. |
| Cleaning | 1 | 30 sec. |

The composition of the color developing solution used was as follows:

| | |
|---|---|
| Potassium carbonate | 28 g |
| Sodium hydrogen carbonate | 2.5 g |
| Potassium sulfite | 3.0 g |
| Sodium bromide | 1.2 g |
| Potassium iodide | 1.2 mg |
| Hydroxylamine sulfate | 2.5 g |
| Sodium diethylenetriamine pentaacetate | 2.0 g |
| 4-amino-3-methyl-N-ethyl-N-(β-hydroxyethyl) aniline sulfate | 4.8 g |
| Potassium hydroxide | 1.2 g |

Water was added to obtain a total quantity of 1 liter, and the pH thereof was adjusted to 10.06 by using potassium hydroxide or a 20% solution of sulfuric acid.

The composition of the color developing replenishing solution used was as follows:

| | |
|---|---|
| Potassium carbonate | 30 g |
| Sodium hydrogen carbonate | 1.0 g |
| Potassium sulfite | 4.3 g |
| Sodium bromide | 0.9 g |
| Hydroxylamine sulfate | 3.0 g |
| Sodium diethylenetriamine pentaacetate | 2.5 g |
| 4-amino-3-methyl-N-ethyl-N-(β-hydroxyethyl) aniline sulfate | 5.5 g |
| Potassium hydroxide | 1.4 g |

Water was added to obtain a total quantity of 1 liter, and the pH thereof was adjusted to 10.12 by using potassium hydroxide or a 20% solution of sulfuric acid.

The composition of the bleaching solution and its replenishing solution was as follows:

| Ammonium ethylnediaminetetra acetate iron | |
|---|---|
| (III) complex | 100 g |
| Ammonium bromide | 140 g |

Water was added to obtain a total quantity of 1 liter, and the pH thereof was adjusted to 5.8 by using glacial acetic acid and aqueous ammonia.

The composition of the non-rinsing fixing solution and its replenishing solution was as follows:

| | |
|---|---|
| Ammonium thiosulfate | 180 g |
| Sodium sulfite anhydrous | 12 g |
| Potassium hydroxide | 1 g |
| Sodium carbonate | 8 g |

Water was added to obtain a total quantity of 1 liter, and the pH thereof was adjusted to 7.0 by using concentrated aqueous ammonia or acetic acid.

The composition of the cleaning solution and its replenishing solution was as follows:

| | |
|---|---|
| 2-methyl-4-isothiazoline-3-on | 0.1 g |

-continued

| | |
|---|---|
| Ethylene glycol | 1 g |

Water was added to obtain a total quantity of 1 liter.

The composition of the cleaning solution and the its replenishing solution was as follows:

| | |
|---|---|
| Formalin (a 35% aqueous solution) | 7.0 ml |
| 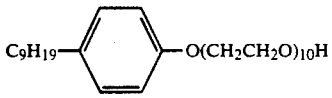 | 1.5 ml |

Water was added to obtain a total quantity of 1 liter.

The surface active agents shown in the following table 1 were properly added respectively to the above-mentioned stabilizing solution and the respective running tests were conducted while adjusting the surface tension of each of them as shown in Table 1. The amounts of replenishing solution added were 600 ml for color development and stabilizing, 300 ml for bleaching and 700 ml for fixing and cleaning per 1 m of the sample film respectively. This running tests were discontinuously conducted until the total amount of replenishment of the non-rinsing stabilizing solution became three times the volume of the non-rinsing stabilizing tank. After the completion of the running tests, the density of red color passing through the unexposed section of each processed sample film was measured by a photoelectric densitometer PDA-65 (manufactured by Konishiroku Photo Industry Co., Ltd.).

Further, each of the processed sample films was stored for 15 days so that the film had $1.5\times10^7$ lux by use of a xenon lamp at a temperature of 70° C. and a relative humidity of 70% RH, red transmission density through the maximum density portion was measured by the above-mentioned densitometer and the discoloring rates (%) before and after the storage of the films were obtained with the results collectively shown in the Table 1.

TABLE 1

| Experiment No. | Sample film (Dielectric constant of high-boiling point solvent) | Stabilizing solution Surface active agent (Surface tension) | Results: Unexposed section Stain (cyan) | Results: Discoloring rate (%) |
|---|---|---|---|---|
| 1 (Comparison) | Sample (1) (7.5) | Not added (65 dyne/cm) | 0.05 | 18.4 |
| 2 (Comparison) | Sample (2) (2.2) | Not added (66 dyne/cm) | 0.07 | 21.0 |
| 3 (Comparison) | Sample (2) (2.2) | III-(xii) (35 dyne/cm) | 0.04 | 17.6 |
| 4 (This invention) | Sample (1) (7.5) | III-(xii) (35 dyne/cm) | 0.01 | 8.1 |
| 5 (This invention) | Sample (1) (7.5) | IV-(xiii) (38 dyne/cm) | 0.01 | 8.8 |
| 6 (This invention) | Sample (1) (7.5) | V-(vii) (36 dyne/cm) | 0.01 | 8.2 |
| 7 (This invention) | Sample (1) (7.5) | VI-(ix) (33 dyne/cm) | 0.01 | 9.3 |

From the table in the previous page, it will be understood that in case the high-boiling point solvents of this invention are used in the sample films and the surface tension of each of the stabilizing solutions is within the range determined in this invention, the unexposed sections of each film are free of stains and to be more surprising, a favorable discoloring prevention effect against light in a high-temperature and high-humidity atmosphere is obtained. However, these effects will not be obtained if the solvents and the stabilizing solution are not used together.

Example 2

A sample film (3) was prepared by using the exemplified compounds III-(xii) in the color negative photosensitive material of the embodiment 1 with other conditions being same as the sample film (1) of the example 1.

As a result of a running test conducted in the same manner as the test of the example 1, it was found that the surface tension of the stabilizing solution was in the order of 37 dyne/cm at the time of termination of the test.

Then the sample film (3) was processed with the above converging solution and the same experiment as that in the example 1 was conducted with extremely favorable results. That is, the cyan stain density of the unexposed section was 0.01 and the discoloring rate was 8.4%

From the above, it will be understood that the effects of this invention can also be obtained in such a manner that the surface active agent of this invention is added to a photosensitive material and liquated into the stabilizing solution and the surface tension of the stabilizing solution is controlled to the range defined in this invention.

Example 3

The exemplified compound III-(xii) was properly added to the stabilizing solution used for the experiment 1 in the example 1, the surface tensions of the solution were controlled respectively according to the table 2 and the same experiments as in the case of the example 1 were conducted. The results are collectively shown in the table 2.

However, as it was not possible to keep the surface tension of the stabilizing solution below 30 dynes/cm by using only the compound of III-(xii), silicone was partially used side by side.

TABLE 2

| Experiment No. | Sample film (Dielectric constant of high-boiling point solvent) | Stabilizing solution Surface active agent (Surface tension) | Results: Unexposed section Stain | Results: Discoloring rate (%) |
|---|---|---|---|---|
| 1 (Comparison) | Sample (1) (7.5) | Not added (65 dyne/cm) | 0.05 | 18.4 |
| 8 (This invention) | Sample (1) (7.5) | III-(xii) (60 dyne/cm) | 0.02 | 10.3 |
| 9 (This invention) | Sample (1) (7.5) | III-(xii) (50 dyne/cm) | 0.01 | 8.8 |
| 10 (This invention) | Sample (1) (7.5) | III-(xii) (40 dyne/cm) | 0.01 | 8.2 |
| 11 (This invention) | Sample (1) (7.5) | III-(xii) (30 dyne/cm) | 0.01 | 8.2 |
| 12 (This invention) | Sample (1) (7.5) | III-(xii) (25 dyne/cm) | 0.01 | 9.2 |
| 13 | Sample (1) | III-(xii) | 0.02 | 9.6 |

TABLE 2-continued

| Experiment No. | Sample film (Dielectric constant of high-boiling point solvent) | Stabilizing solution Surface active agent (Surface tension) | Results Unexposed section Stain | Results Discoloring rate (%) |
|---|---|---|---|---|
| (This invention) | (7.5) | (20 dyne/cm) | | |

Further, in the case of the stabilizing solution shown in Table 2, when the surface tension of the solution was less than 20 dyne/cm, the surface of the sample film after drying was stained.

From the table in the previous page, it will be understood that when the surface tension of the stabilizing solution is in the range of 20–60 dyne/cm, it is possible with this invention to produce a favorable effect and when it is in the range of 25–50 dyne/cm, a specifically favorable effect is obtained.

Example 4

The silicone [FS Antifoam 025 (Dow Corning Corp.)] of this invention as pure silicone was added in an amount of 20 mg per 1-liter of the stabilizing solution in the example 2 and the same experiment was conducted to obtain a favorable result with a discoloring rate of 7.3%. Further, when using the FS antifoam BE (Dow Corning Corp.) instead of the FS Antifoam 025, a favorable discoloring rate of 7.5% was obtained.

In addition, when the silicone of this invention was used together, the foaming action of the solution was favorably improved at the time of a running test.

Example 5

The exemplified compounds (C-29) and (C-51) were used instead of the cyan coupler (C-i) used in the sample film (1) of the example 1 and the same experiment was conducted with the results that the discoloring rate of cyan color against light in a high-temperature and high-humidity atmosphere was improved by 2–3% only in the examples of this invention.

Example 6

The same experiment as in the example 1 was conducted without using the anti-molding agent (2-methyl-4-isothiazoline-3-on) used for the stabilizing solution of the example 1 and it was found that, although the effect of this invention were produced, the surface of the sample film was somewhat stained and the color stain generating condition was worsened by about 0.01.

What is claimed is:

1. A method of processing a silver halide color photosensitive material comprising exposing said photosensitive material and processing said exposed photosensitive material at a rate of greater than or equal to 3 m/min, wherein said processing comprises:

(a) color developing, (b) processing said photosensitive material with a solution having a bleaching ability and with a solution having a fixing ability, (c) subsequently processing said photosensitive material with a final stabilizing solution which comprises at least one compound represented by formula III, IV, V or VI, said stabilizing solution having a surface tension of 20 to 60 dyne/cm measured at 20° C., said solution further comprising an emulsion type silicone compound, and said subsequent processing being carried out substantially without undergoing a rinsing process with water between the processing step; with formula III being

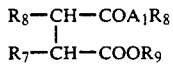

wherein one of $R_6$ and $R_7$ is a hydrogen atom and the other one is a group represented by $—SO_3M$, wherein M is a hydrogen atom or a monovalent cation, $A_1$ is an oxygen atom or a group represented by $—NR_{10}—$, wherein $R_{10}$ is a hydrogen atom or an alkyl group having 1 to 8 carbon atoms, $R_8$ and $R_9$ independently represent an alkyl group having 4 to 16 carbon atoms provided that said alkyl group represented by $R_8$, $R_9$ and $R_{10}$ may be substituted by at least one fluorine atom;

formula IV being

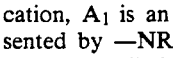

wherein $A_2$ is a monovalent organic group selected from the group consisting of alkyl groups having 6 to 20 carbon atoms and aryl groups which are substituted by an alkyl group having 3 to 12 carbon atoms, B is an ethylene oxide or a propylene oxide, m is an integer of 4 to 50 and $X_1$ is a hydrogen atom, a $—SO_3Y$ group or a $—PO_3Y_2$ group, wherein Y is a hydrogen atom or an alkali metal atom;

formula V being

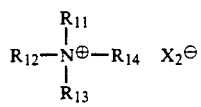

wherein $R_{11}$, $R_{12}$, $R_{13}$ and $R_{14}$ independently represent a hydrogen atom an alkyl group or a phenyl group provided that the total number of carbon atoms contained in $R_{11}$, $R_{12}$, $R_{13}$ and $R_{14}$ is 3 to 50, $X_2$ is anion; and formula VI being

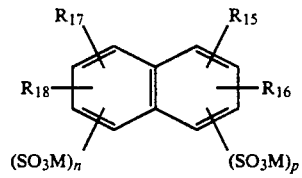

wherein $R_{15}$, $R_{16}$, $R_{17}$ and $R_{18}$ independently represent a hydrogen atom or an alkyl group, M is a hydrogen atom or a monovalent cation and N and P independently represent an integer of 0 to 4 provided that the total sum of n and p is 1 to 8, wherein said photosensitive material comprises a high boiling point organic solvent represented by formula I or formula II having a dielectric constant of 4.0–8.5 and a cyan dye forming coupler represented by formula VII, formula VIII or formula IX, with formula I being

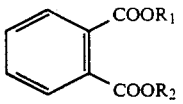

wherein $R_1$ and $R_2$ independently represent an alkyl group, an alkenyl group or aryl group; and formula II being

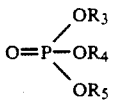

wherein $R_3$, $R_4$ and $R_5$ independently represent an alkyl group, an alkenyl group or an aryl group; and formula VII being

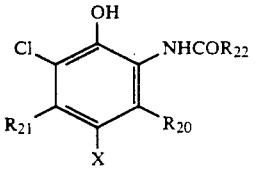

wherein one of $R_{20}$ and $R_{21}$ is a hydrogen atom and the other one is an alkyl group having 2 to 12 carbon atoms and X is a hydrogen atom or group capable of being split off upon reaction with an oxidation product of a color developing agent, $R_{22}$ is a ballasting group, formula VIII being

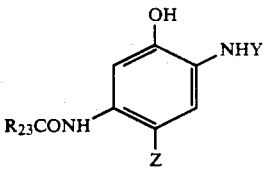

and formula IX being

-continued

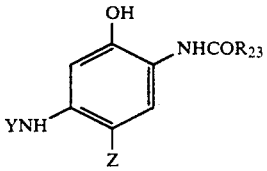

wherein Y is selected from the group consisting of:

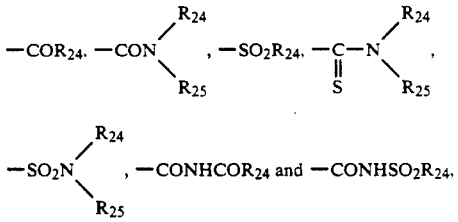

wherein $R_{24}$ is selected from the group consisting of an alkyl group, an alkenyl group, a cycloalkyl group, an aryl group and a heterocyclic group, $R_{25}$ is selected from the group consisting of a hydrogen atom, an alkyl group, an alkenyl group, a cycloalkyl group, an aryl group and a heterocyclic group provided that $R_{24}$ and $R_{25}$ may be cooperatively combined with each other to form a 5-or 6- membered heterocyclic ring, $R_{23}$ is a ballasting group; and Z is a hydrogen atom or a group capable of being split off upon reaction with an oxidation product of a color developing agent.

2. The method of claim 1, wherein said silicone is in the form of oil, solution, compound or emulsion.

3. The method of claim 2, wherein said silicone is contained in said stabilizing solution in a quantity of 1 mg to 1 g per liter of said solution in terms of a pure silicone.

4. The method of claim 3, wherein said silicone is contained in said stabilizing solution in a quantity of 3 mg to 200 mg in terms of a pure silicone.

5. The method of claim 1, wherein said stabilizing solution has a surface tension of 25 to 60 dyne/cm.

6. The method of claim 1, wherein said stabilizing solution contains a chelating agent of which chelating stability constant against ferric ion is not less than 6.

7. The method of claim 1, wherein said stabilizing solution contains an anti-molding agent.

8. The method of claim 1, wherein said stabilizing solution has a pH value of 3.0 to 9.5.

9. The method of claim 8, wherein said stabilizing solution has a pH value of 3.5 to 9.0.

* * * * *

UNITED STATES PATENT AND TRADEMARK OFFICE

CERTIFICATE OF CORRECTION

PATENT NO. : 5,225,320

DATED : July 06, 1993

INVENTOR(S) : Satoru KUSE et al.

It is certified that error appears in the above-indentified patent and that said Letters Patent is hereby corrected as shown below:

On the title page, Abstract, line 6, change "photo sensitive" to --photosensitive--.

In claim 1, column 64, approximately line 7, change "$R_8$-CH-$COA_1R_8$" on the top line of formula III to --$R_6$-CH-$COA_1R_8$--

In claim 1, line 44, after "atom" insert a comma.

Signed and Sealed this

Tenth Day of May, 1994

Bruce Lehman

*Attest:*

BRUCE LEHMAN

*Attesting Officer*

*Commissioner of Patents and Trademarks*